US007730646B2

(12) United States Patent
Kunizawa et al.

(10) Patent No.: US 7,730,646 B2
(45) Date of Patent: Jun. 8, 2010

(54) SWIVEL WORK MACHINE

(75) Inventors: Teruo Kunizawa, Sakai (JP); Masaaki Ueda, Sakai (JP); Hiroshi Horii, Sakai (JP); Keisuke Miura, Izumisano (JP)

(73) Assignee: Kubota Corporation, Osaka (JP)

( * ) Notice: Subject to any disclaimer, the term of this patent is extended or adjusted under 35 U.S.C. 154(b) by 103 days.

(21) Appl. No.: 12/197,435

(22) Filed: Aug. 25, 2008

(65) Prior Publication Data

US 2009/0056964 A1 Mar. 5, 2009

(30) Foreign Application Priority Data

Aug. 27, 2007 (JP) ..... 2007-220001

(51) Int. Cl.
*E02F 5/02* (2006.01)

(52) U.S. Cl. ..... 37/348

(58) Field of Classification Search ..... 37/347, 37/348, 466, 468, 382; 172/2–11, 781, 803–809; 701/50; 60/420–422, 494, 428, 429
See application file for complete search history.

(56) References Cited

U.S. PATENT DOCUMENTS 4,189,010 A * 2/1980 Meisel, Jr. ..... 172/822
5,584,346 A * 12/1996 Sakamoto et al. ..... 172/4.5
7,487,609 B2 * 2/2009 Nakamura et al. ..... 37/348
7,571,558 B2 * 8/2009 Horii ..... 37/348

FOREIGN PATENT DOCUMENTS

| | | |
|---|---|---|
| JP | 08270017 | 10/1996 |
| JP | 2000240093 | 9/2000 |
| JP | 2005207195 | 8/2005 |

* cited by examiner

*Primary Examiner*—Robert E Pezzuto
(74) *Attorney, Agent, or Firm*—The Webb Law Firm

(57) ABSTRACT

A swivel work machine comprises: a travel device; a swivel base provided on the travel device; a swivel base provided in the front of the travel device; a dozer provided to the travel device; a swing control; a dozer control; a tilt control member provided to the dozer control, an actuation of the tilt control member causing the dozer to be pivoted about the tilt pivot shaft; a controller having a swing control mode in which an actuation of the swing control causes the implement to be pivoted laterally, and an angle control mode in which an actuation of the swing control causes the dozer to be pivoted about the angle pivot shaft; and a mode change-over portion for switching a control mode of the controller between the swing control mode and the angle control mode.

10 Claims, 12 Drawing Sheets

SWIVEL WORK MACHINE

BACKGROUND OF THE INVENTION

1. Field of the Invention

The present invention relates to a swivel work machine, such as construction or civil-engineering machinery such as a backhoe, equipped with a dozer device.

2. Description of the Related Art

There exist swivel work machines, such as a backhoe, that are equipped with a dozer device and that are provided with a swivel base on a travel device, an implement arranged in a front part of the swivel base such that the implement can pivot laterally, and a swing cylinder for laterally swinging the implement. Such swivel work machine has the dozer device at the front part of the travel device. The dozer device is provided with a pivot support supported to the travel device to be vertically pivotable, a blade supported to a front end side of the pivot support to be pivotable about an angle pivot shaft extending in a vertical direction, and also about a tilt pivot shaft extending in a fore-and-aft direction, and a dozer cylinder for pivoting the pivot support vertically, an angle cylinder for pivoting the blade about the angle pivot shaft as well as a tilt cylinder for pivoting the blade about the tilt pivot shaft. A dozer lever is provided, and the dozer cylinder is extended and retracted to effect vertical pivoting of the pivot support in correlation with an actuation of the dozer lever. (See for example, JP-A-2005-207195, JP-A-2000-240093, and JP-A-8-270017.)

Among this kind of conventional swivel work machines is a machine that has a dozer lever provided with a button switch and that is configured to extend and retract the dozer cylinder to pivot the pivot support vertically by operating the dozer lever in the fore-and-aft direction, and configured to extend and retract the tilt cylinder to pivot the blade vertically about the tilt pivot shaft by pivoting the dozer lever laterally without depressing the button switch, and to extend and retract the angle cylinder to pivot the blade laterally about the angle pivot shaft by pivoting the dozer lever laterally with the button switch depressed (see for example, JP-A-2005-207195). There are also conventional swivel work machines in which a tilting and an angular pivoting of the blade is selected by an operation switch provided in the control area. There are also machines in which a control knob of the blade lever for causing vertical pivoting of the swing support has an electric 4-way switch for selecting between angular pivoting and tilting operations of the blade, and which are configured such that the output signals from the switches when depressed are sent to an electromagnetic valve located in a hydraulic circuit for switching between the angle cylinder and the tilt cylinder and to an electromagnetic valve for switching between an extension and retraction of the selected valve also located in the hydraulic circuit, to effect lateral angular pivoting and lateral tilting of the blade (See JP-A-2000-240093, JP-A-8-270017).

SUMMARY OF THE INVENTION

However, in conventional swivel work machines, it was not possible to pivot the blade vertically about the tilt pivot shaft and laterally (or to the right or left) about the angle pivot shaft simultaneously, which was inconvenient.

In light of the shortcoming identified above, the present invention provides a machine which allows pivoting of the blade vertically about the tilt pivot shaft and laterally (or to the right or left) about the angle pivot shaft simultaneously.

A swivel work machine in accordance with the present invention comprises a travel device; a swivel base provided on the travel device; an implement provided to a front portion of the swivel base, the implement being capable of being pivoted to the right or left; a dozer provided to the travel device, the dozer being supported so as to be capable of being pivoted vertically, of being pivoted about an angle pivot shaft extending vertically, and of being pivoted about a tilt pivot shaft extending in a fore-and-aft direction; a swing control, an actuation of which causes the implement to be pivoted to the right or left; a dozer control, an actuation of which causes the dozer to be pivoted vertically; a tilt control member provided to the dozer control, an actuation of the tilt control member causing the dozer to be pivoted about the tilt pivot shaft; a controller having a swing control mode in which an actuation of the swing control causes the implement to be pivoted vertically, and an angle control mode in which an actuation of the swing control causes the dozer to be pivoted about the angle pivot shaft; and a mode change-over portion for switching a control mode of the controller between the swing control mode and the angle control mode.

The present configuration allows for a switching between the angle control mode in which the dozer is pivoted about the angle pivot shaft in correlation with an actuation of the swing control and the swing control mode in which the implement is swung in correlation with an actuation of the swing control. Thus, by switching to the angle control mode, the dozer can be pivoted vertically about the tilt pivot shaft and pivoted to the right or left about the angle pivot shaft simultaneously by actuating the swing control and the tilt control member, which is convenient. Further, since the tilt control member is provided to the dozer control, it is easy to vertically pivot a pivot support of the dozer by actuating the dozer control, simultaneously with a pivoting of the dozer vertically about the tilt pivot shaft and to the right or left about the angle pivot shaft, which is very convenient during a work operation.

Alternatively, a swivel work machine in accordance with the present invention comprises: a travel device; a swivel base provided on the travel device; an implement provided to a front portion of the swivel base, the implement being capable of being pivoted to the right or left; a dozer provided to the travel device, the dozer being supported so as to be capable of being pivoted vertically, of being pivoted about an angle pivot shaft extending vertically, and of being pivoted about a tilt pivot shaft extending in a fore-and-aft direction; a swing control, an actuation of which causes the implement to be pivoted to the right or left; a dozer control, an actuation of which causes the dozer to be pivoted vertically; an angle control member provided to the dozer control, an actuation of the angle control member causing the dozer to be pivoted about the angle pivot shaft; a controller having a swing control mode in which an actuation of the swing control causes the implement to be pivoted vertically, and a tilt control mode in which an actuation of the swing control causes the dozer to be pivoted about the tilt pivot shaft; and a mode change-over portion for switching a control mode of the controller between the swing control mode and the tilt control mode.

This configuration allows for a switching between the tilt control mode in which the dozer is pivoted about the tilt pivot shaft in correlation with an actuation of the swing control and the swing control mode in which the implement is swung in correlation with an actuation of the swing control. Thus, by switching to the tilt control mode, the dozer can be pivoted to the right or left about the angle pivot shaft and pivoted vertically about the tilt pivot shaft simultaneously by actuating the swing control and the angle control member, which is convenient. Further, since the angle control member is provided to the dozer control, it is easy to vertically pivot the pivot support of the dozer by actuating the dozer control, simultaneously with a pivoting of the dozer to the right or left about the angle pivot shaft and vertically about the tilt pivot shaft, which is very convenient during a work operation.

In the swivel work machine described above, it is preferable that the dozer control includes a dozer lever configured to be pivoted by hand, and the swing control includes a swing pedal configured to be stepped on by a foot.

In addition, it is preferable in the swivel work machine that the dozer control and the swing control are located on the same side with respect to a driver's seat in a right/left direction.

Also, it is preferable in the swivel work machine described above that the tilt control member is provided in a vicinity of a top end of the dozer lever.

In addition, it is preferable in the swivel work machine described above that the tilt control member or the angle control member is a seesaw switch, and the dozer is pivoted about the tilt pivot shaft or about the angle pivot shaft in a direction corresponding to a pivoting direction of the seesaw switch.

DESCRIPTION OF THE PREFERRED EMBODIMENTS

The present invention will be described next with reference to the illustrated embodiments.

Figure 1:
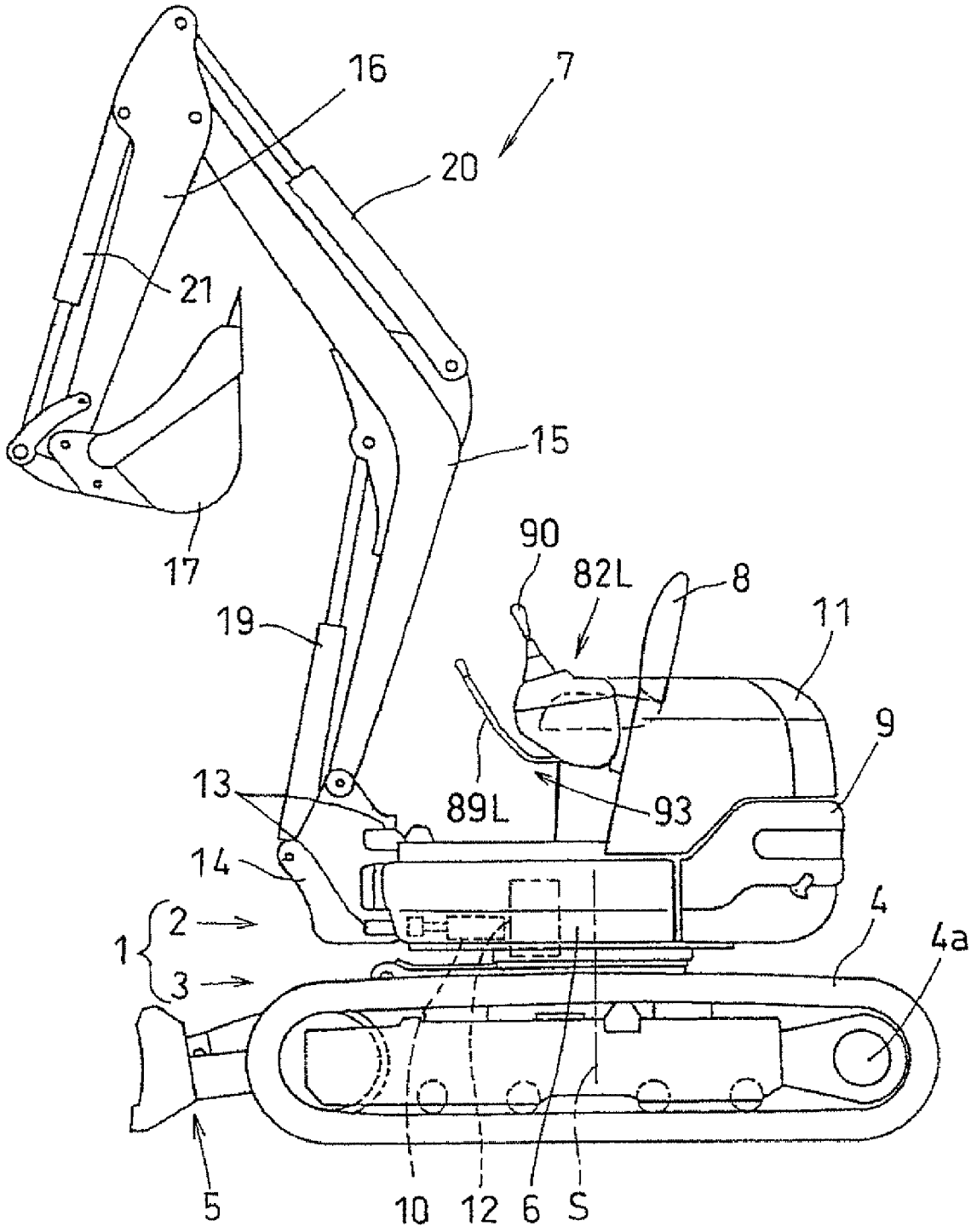
FIG. 1 shows a side view of a backhoe in accordance with one embodiment of the present invention.
Figure 2:
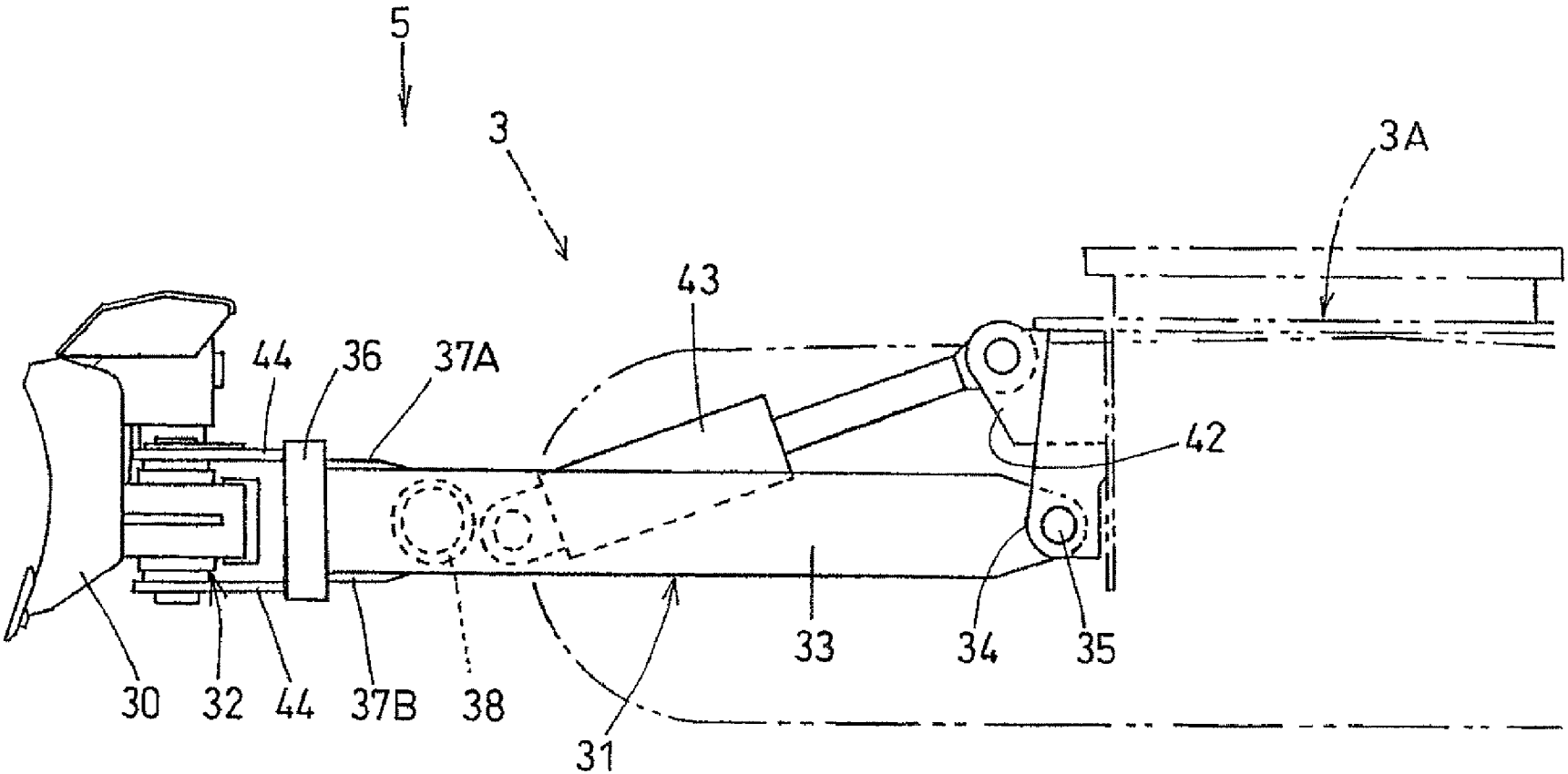
FIG. 2 shows a side view of a dozer device.

Referring to FIG. 1, a backhoe 1 is illustrated as an example of a swivel work machine and has an upper swing body 2 and a lower travel device 3 as main components.

The travel device 3 has a pair of right and left travel elements 4 that are of a rubber crawler type driven by a hydraulic travel motor 4*a*, and has a dozer device 5 in the front.

The swing body 2 has a swivel base 6 supported on the travel device 3 for swinging movements to the right and left about a vertically extending axis S, an implement (an excavating tool, or an operational part) 7 arranged in a front part of the swivel base 6, and a driver's seat 8 provided on the swivel base 6, etc. The swivel base 6 is configured to swing about the swing axis S by means of a swing motor 12.

A rear part of the swivel base 6 has a counterweight 9 for maintaining balance with the implement (an operational part) 7, etc. An engine and a radiator, etc. are arranged at a rear of the swivel base 6, and are covered by a hood 11. A driver's seat 8 is arranged forwardly of the hood 11.

A support bracket 13 is provided in the front part of the swivel base 6, and a pivot bracket 14 is supported by this support bracket 13 so as to be pivotable to the right or left (or laterally) about a vertically extending axis. The pivot bracket 14 is pivotable through extension and retraction of a swing cylinder 10 provided within the swivel base 6. Thus, the implement 7 is configured to swing to the right or left by means of the swing cylinder 10.

The implement 7 has a boom (an operational part) 15 which has a base side pivotably supported by said pivot bracket 14, an arm (an operational part) 16 which has a base side supported pivotably to a distal end of the boom 15, and a bucket (an operational part) 17 supported to a distal end of the arm 16 such that the bucket 7 can scoop and dump materials.

These members are respectively actuated by a boom hydraulic cylinder 19, an arm cylinder 20 and bucket cylinder 21, each of which is an hydraulic cylinder.

As shown in FIGS. 2-7, the travel device 3 has a dozer device 5 (a tilt/angle dozer device) in the front part thereof.

This dozer device 5 has a blade 30 in the front part. The blade 30 is attached to the front of a pivot support 31 which is supported vertically pivotably by a track frame 3A of the travel device 3, by means of a cross pin structure 32.

Figure 3:
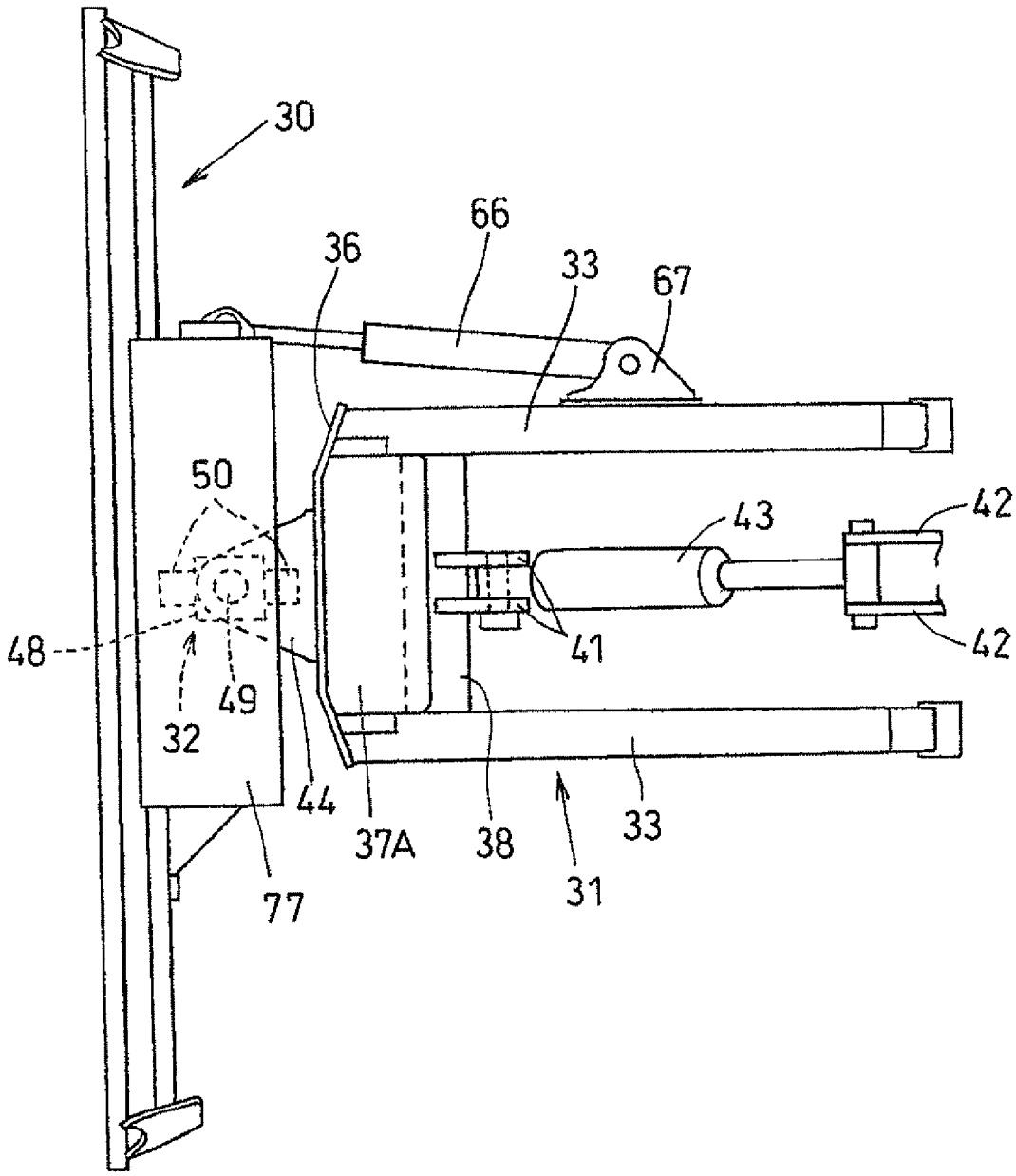
FIG. 3 shows a plan view of the dozer device.
Figure 4:
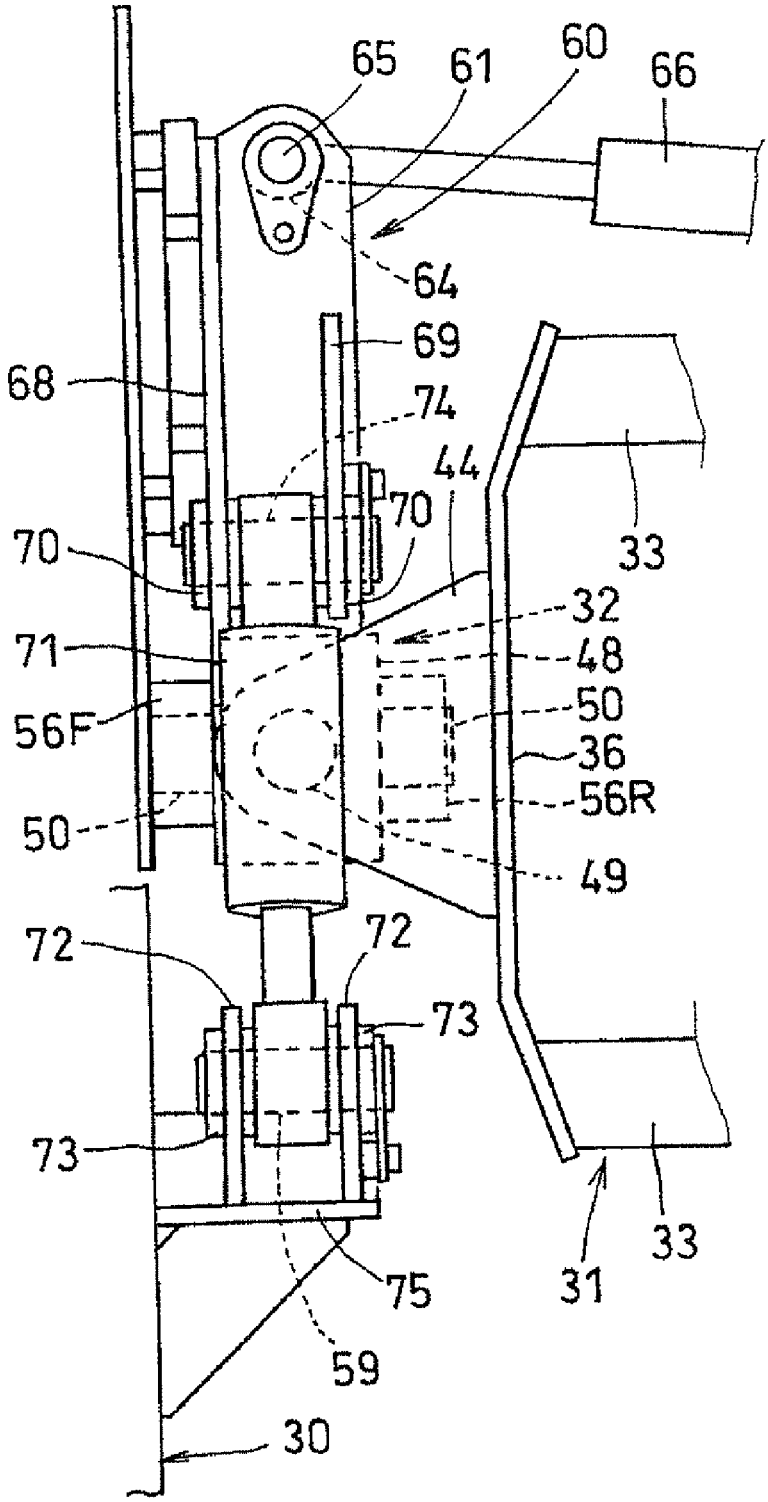
FIG. 4 shows a plan view of a blade attachment portion.
Figure 5:
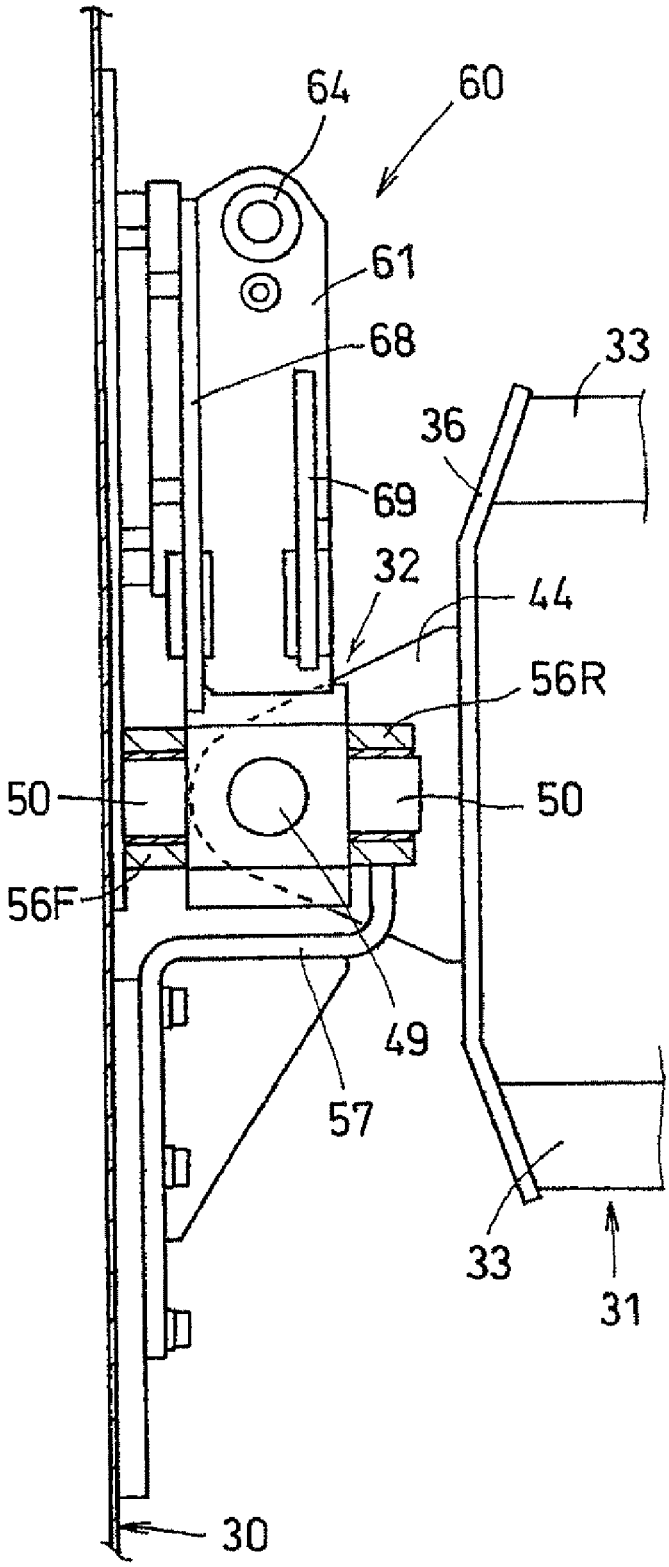
FIG. 5 shows a plan view of the blade attachment portion.
Figure 6:
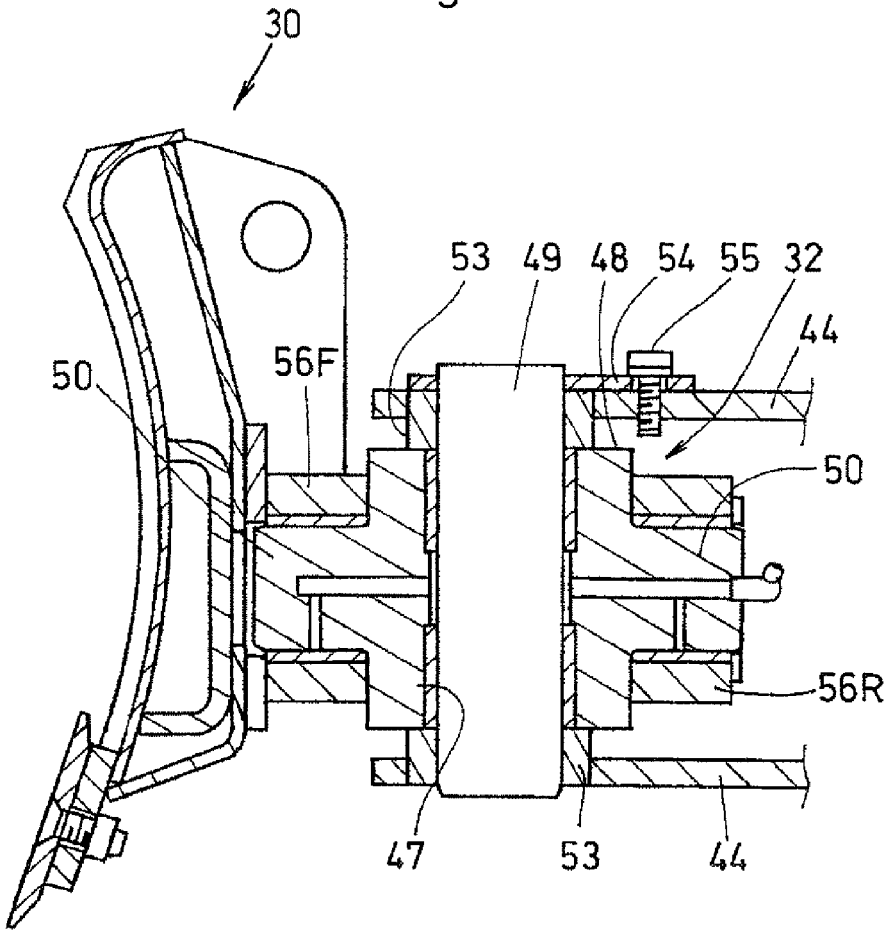
FIG. 6 shows a side sectional view of the blade attachment portion.
Figure 7:
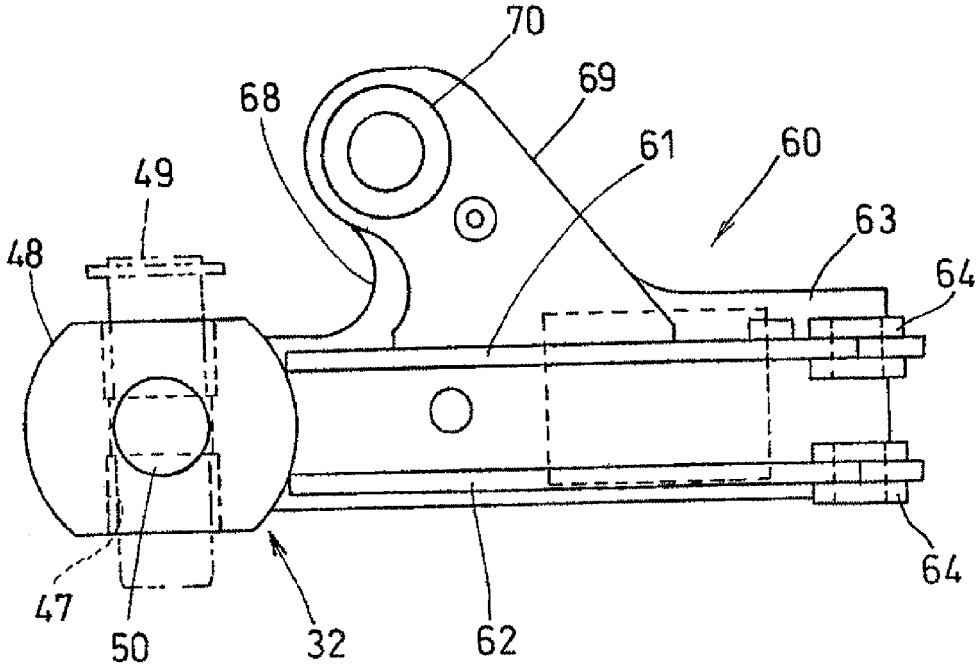
FIG. 7 shows a rear view of a cross pin structure and a tilt frame.

The pivot support 31 has a pair of right and left pivot arms 33 as shown in FIG. 3. The rear ends of these right and left pivot arms 33 are attached to the bracket 34 provided to the track frame 3A of the travel device 3 through a pivot 35 so as to be pivotable about a laterally extending axis (i.e. extending in a right and left direction) so that the pivot support 31 can pivot vertically about the laterally extending pivot 35.

The right and left pivot arms 33 are connected to each other by a front wall 36 at the front, upper and lower walls 37A and 37B, and a connecting member 38.

A pair of right and left brackets 41 is provided in a lateral midway portion of the connecting member 38. A dozer cylinder 43, which is a hydraulic cylinder, is arranged between these brackets 41 and the brackets 42 provided to the track frame 3A of the travel device 3 so that the pivot support 31 can be pivoted vertically by extending and retracting the dozer cylinder 43.

A pair of upper and lower support brackets 44 fixed to the front wall 36 is provided to the front part of the pivot support 31.

The cross pin structure 32 has a body 48, an angle pivot shaft 49, and a pair of front and rear tilt pivot shafts 50, as shown in FIGS. 2-6. An insertion hole 47 is formed in and through the body 48 of the cross pin structure 32, and the angle pivot shaft 49 is inserted in the insertion hole 47 so as to be pivotable about the axis with one or more bushings interposed between the axis 49 and the hole 47. The pair of front and rear tilt pivot shafts 50 are integrally provided with the body 48 such that the axes 50 extend perpendicular to the axial center of the angle pivot shaft 49.

The angle pivot shaft 49 also extends through a boss 53 provided to each of the upper and lower support bracket 44 at a front of the pivot support 31. A fixing plate 54 fixed to the upper side of the angle pivot shaft 49 is fixed to the upper support bracket 44 with a bolt 55. With this structure, the body 48 of the cross pin structure 32 is supported by the support bracket 44 so as to be pivotable about an axial center of an angle pivot shaft 49.

With the cross pin structure 32 attached to the support bracket 44, the pair of tilt pivot shafts 50 are located forwardly and rearwardly of the body 48, and each of cylinders 56F and 56R is fit onto respective tilt pivot shaft 50 through a bush so as to be pivotable about the axis.

The front side cylinder 56F is fixed to the back side of the blade 30, and the rear side cylinder 56R is fixed to the back side of the blade 30 through a bracket 57; thus, the blade 30 is supported by the cross pin structure 32 about the axial center of the tilt pivot shaft 50.

In addition, a tilt frame 60 is fixedly attached to (the right hand side of) the body 48 of the cross pin structure 32 by welding etc., so that the tilt frame 60 is integral with the cross pin structure 32 (i.e. the tilt frame 60 is extended integrally from the cross pin structure 32).

This tilt frame 60 has, as its main components, upper and lower frame forming members 61 and 62 whose one side (left side) ends are fixed by welding to the body 48 of a cross pin structure 32, and a front frame forming member 63 fixed by welding to the upper and lower frame forming members 61 and 62 and to the body 48.

A boss 64 is provided to the other end side (right end side) of each of the upper and lower frame forming members 61 and 62, respectively, and one end (i.e. cylinder rod end) of the angle cylinder 66, which is a hydraulic cylinder, is attached and supported through an axis 65 inserted in this boss 64 for rotation about an axial center parallel to the axial center of the angle pivot shaft 49.

The other end (or the cylinder body side) of this angle cylinder 66 is attached and supported to a bracket 67 provided to a right-hand side surface (of the right pivot arm 33) of the pivot support 31 so as to be pivotable about an axial center parallel to the angle pivot shaft 49.

Therefore, by extending and retracting the angle cylinder, the right and left ends of the blade 30 pivot forward and backward with the tilt frame 60 and the cross pin structure 32 about the axial center of the angle pivot shaft 49.

A bracket 68 extends integrally and upwardly from the front frame forming member 63, and a bracket 69 is provided to stand vertical on, and fixed by welding to, the upper frame forming member 61 rearwardly of this bracket 68. A boss 70 is provided in these brackets 68 and 69, respectively.

A pair of front and rear brackets 72 is provided to a support member 75 fixed to an upper part of the back of a blade 30, and a boss 73 is provided in each of these brackets 72.

And one end side (cylinder body side) of the tilt cylinder 71, which is a hydraulic cylinder, is attached, between the bosses 70 of a tilt frame 60, through an pivot axis 74 to be pivotable about an axis parallel to an axial center of the tilt pivot shafts (or shaft) 50. The other end (cylinder rod end) of the tilt cylinder 71 is pivotably attached between the bosses 73 of the blade 30 through an axis 59 to be rotatable about an axial center parallel to an axial center of tilt pivot shafts (or shaft) 50.

Therefore, by extending and retracting the tilt cylinder 71, right and left ends of the blade 30 pivots vertically about the axial center of the tilt pivot shafts (or shaft) 50 with respect to the tilt frame 60 and the cross pin structure 32.

Incidentally, shown at numeral 77 is a cover which covers, among other things, the tilt cylinder 71, and is attached to the blade 30.

The tilt frame 60 engages the blade 30 such that it can not be separated rearwardly further from the blade 30 while it is allowed to pivot about the tilt pivot shafts (or shaft) 50 of the blade 30.

Figure 8:
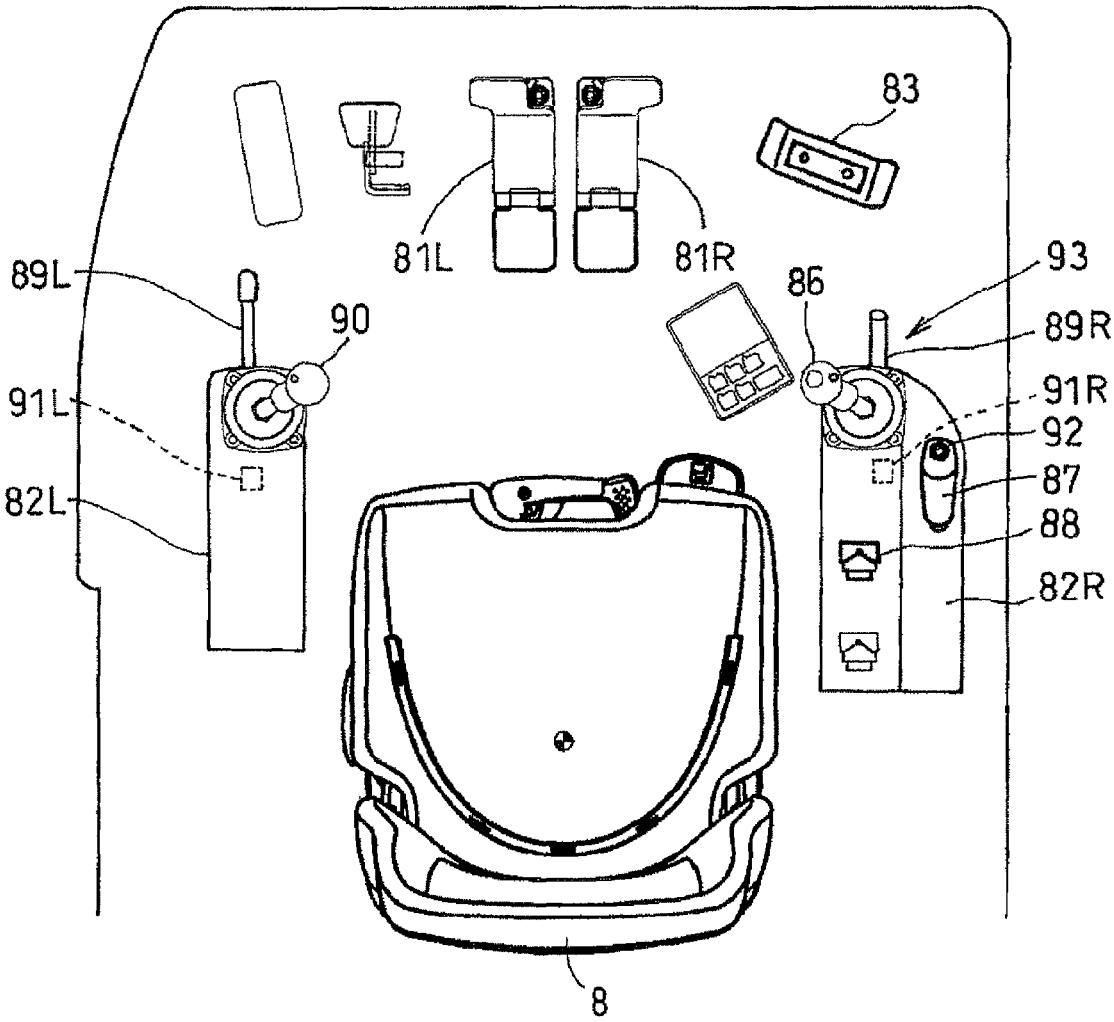
FIG. 8 shows an arrangement of control members around a driver's seat.

As shown in FIG. 8, a pair of right and left drive pedals 81R and 81L for separately controlling travel motors 4*a* for the travel elements 4 are arranged forwardly of the driver's seat 8*a* on the swivel base 6, and control panels 82R and 82L are arranged on either side of the drivers seat 8. A swing pedal 83 for controlling swing operations is provided to the right of the pair of right and left drive pedals 81R and 81L. The swing pedal 83 is pivotably supported such that it can be pivoted to a left-side down position or a right-side down position, and is urged to a horizontal neutral position by a spring (not shown). The swing pedal 83 is configured to be pivoted either to a right-side down position or to a left-side down position by stepping on either the right end portion or the left end portion of the swing pedal 83.

The control panel 82R on the right is provided with a boom and bucket control lever 86 for manipulating the boom 15 and the bucket 17, a dozer lever 87, which is the dozer manipulating tool for manipulating the dozer device 5, a right lock lever 89R, and a change-over switch 88. The dozer lever 87 and the swing pedal 83 are arranged on the same side in the lateral direction with respect to the driver's seat, and in particular, to the right of the driver's seat 8.

The left control panel 82L is provided with a swing and arm control lever 90 for controlling both the swing motor 12 for swinging the swivel base 6 about the swing center S and the arm 16, as well as a left lock lever 89L.

Figure 9:
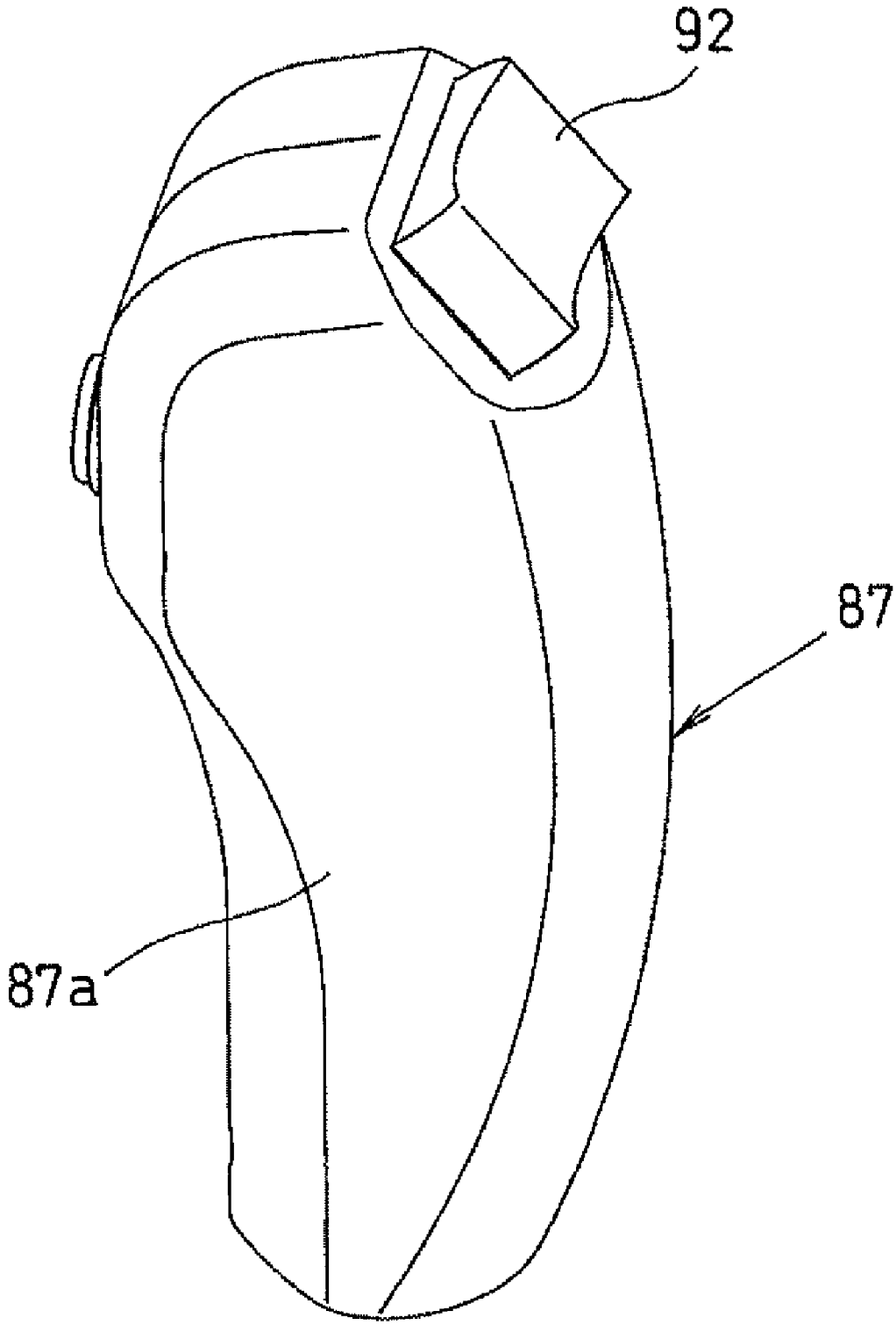
FIG. 9 shows a perspective view of a grip portion of a dozer lever.

As shown in FIG. 9, a tilt control member 92 is provided on the backside of an upper end of the grip 87*a* of the dozer lever 87. This tilt control member 92 includes a seesaw switch which has the potentiometer etc., and pivots to the right as the right-hand side of the tilt control member 92 is depressed, and pivots to the left as the left-hand side of the tilt control member 92 is depressed. The tilt control member 92 is configured to an output operation signal S1 with a current or voltage of a magnitude corresponding to the amount of right or left pivoting of the tilt control member 92. The tilt control member 92 is configured to return from the right or left pivoted position to the neutral position by the urging of the spring as the member 92 is released.

Figure 10:
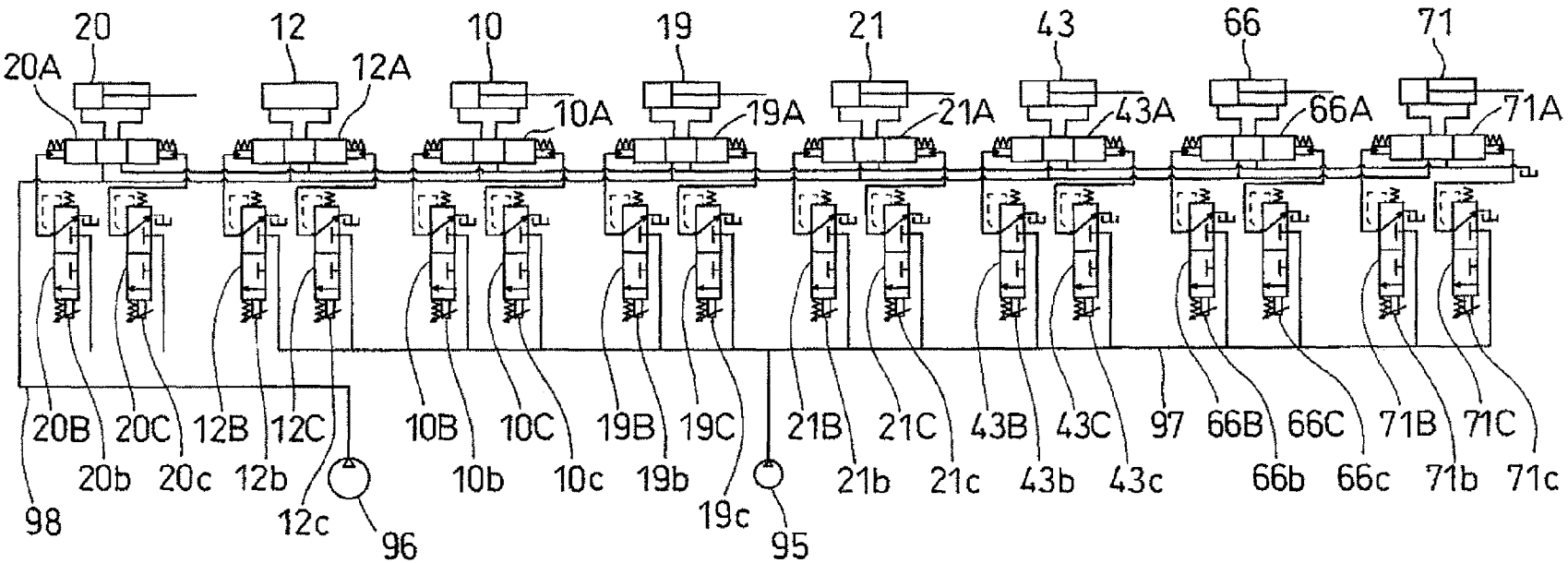
FIG. 10 is a drawing showing a hydraulic-circuit.

FIG. 10 shows the hydraulic circuit for actuating, for example, arm cylinder 20. In FIG. 10, 20A is a control valve for the arm cylinder; 12A is a control valve for the swing motor; 10A is a control valve for the swing cylinder; 19A is a control valve for the boom cylinder; 21A is a control valve for the bucket cylinder; 43A is a control valve for dozer cylinder; 66A is a control valve for angle cylinder; and 71A is a control valve for the tilt cylinder. Indicated at numeral 20B is an electromagnetic valve for pivoting the arm forwardly; 20C is an electromagnetic valve for pivoting the arm rearwardly; 12B is an electromagnetic valve for swinging operation to the left; 12C is an electromagnetic valve for swinging operation to the right; 10B is an electromagnetic valve for swinging to the left; 10C is an electromagnetic valve for swinging to the right; 19B is an electromagnetic valve for raising the boom; 19C is an electromagnetic valve for lowering the boom; 21B is an electromagnetic valve for a bucket scooping; 21C is an electromagnetic valve for a bucket dumping; 43B is an electromagnetic valve for raising the dozer; 43C is the electromagnetic valve for lowering the dozer; 66B is an electromagnetic valve for pivoting the blade to the left; 66C is an electromagnetic valve for pivoting the blade to the right; 71B is an electromagnetic valve for pivoting the blade to a left-side up position; 71C is an electromagnetic valve for pivoting the blade to a right-side up position; each with a respective solenoid 20*b*, 20*c*, 12*b*, 12*c*, 10*b*, 10*c*, 19*b*, 19*c*, 21*b*, 21*c*, 43*b*, 43*c*, 66*b*, 66*c*, 71*b*, or 71*c*. Indicated by numeral 95 is the first pump and 96 is the second pump.

Pilot oil is supplied to each of the electromagnetic valves 20B, 20C, 12B, 12C, 10B, 10C, 19B, 19C, 21B, 21C, 43B, 43C, 66B, 66C, 71B, and 71C from the first pump 95 through the first hydraulic path 97. By opening or closing each of the electromagnetic valves 20B, 20C, 12B, 12C, 10B, 10C, 19B, 19C, 21B, 21C, 43B, 43C, 66B, 66C, 71B, and 71C, the pilot pressure acting on each of the control valves 20A, 12A, 10A, 19A, 21A, 43A, 66A, and 71A changes. Hydraulic fluid is supplied to each of the control valves 20A, 12A, 10A, 19A, 21A, 43A, 66A, and 71A from the second pump 96 through the second hydraulic path 98. The amount of valve travel or opening of the control valves 20A, 12A, 10A, 19A, 21A, 43A, 66A, and 71A is determined depending on the pilot pressure acting on each of the control valves 20A, 12A, 10A, 19A, 21A, 43A, 66A, and 71A and hydraulic fluid is supplied to each of the corresponding cylinders 20, 10, 19, 21, 43, 66, and 71 or the swing motor 12 (an actuator).

Figure 11:
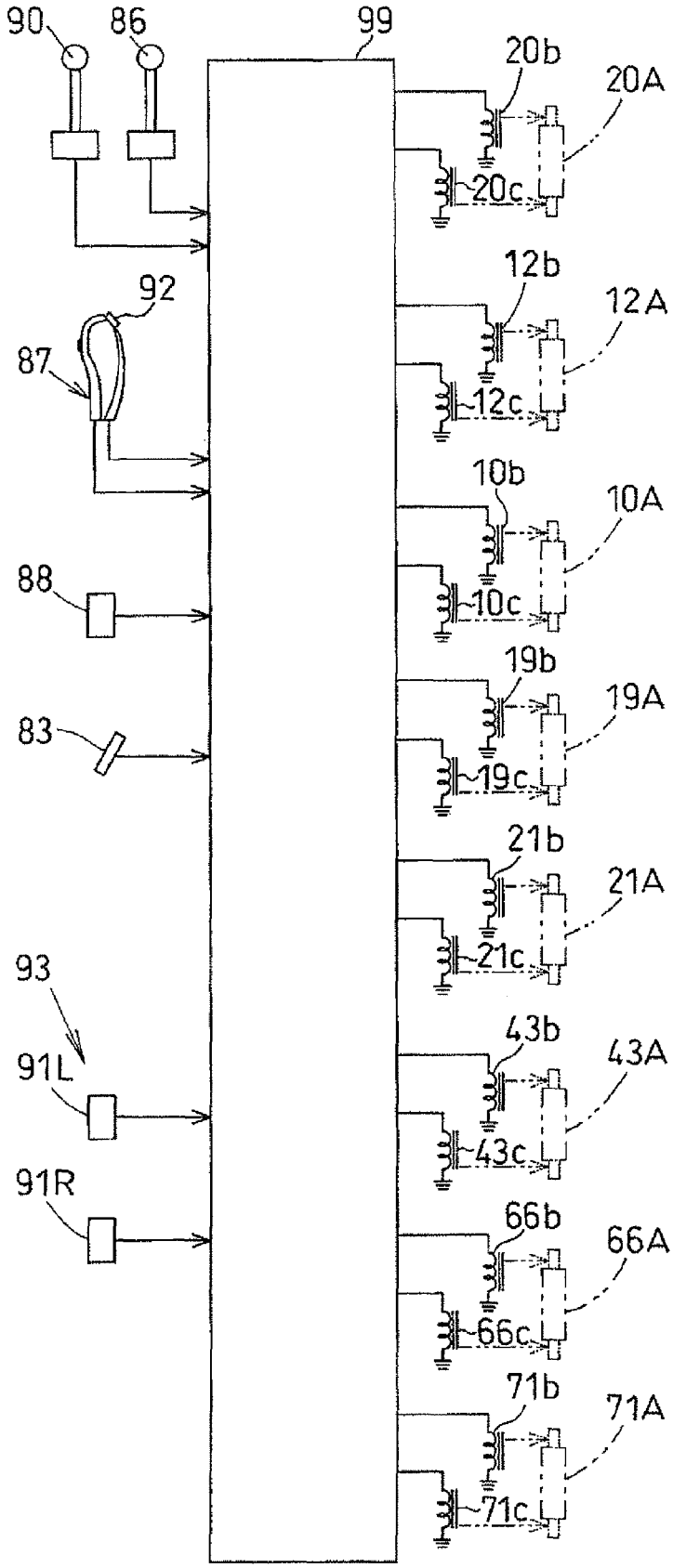
FIG. 11 shows a schematic view of an electrical-control system.

FIG. 11 shows the configuration of the electrical control system. In FIG. 11, numeral 99 denotes a controller which includes a CPU, memory, etc. The controller 99 is configured to receive, as inputs, operation signals S1 from the swing pedal 83, the boom and bucket control lever 86, the swing and arm control lever 90, the dozer lever 87, the tilt control member 92 of the dozer lever 87, also to receive the change-over signals from the change-over switch 88, the change-over switch 91L of the left lock lever 89L, and the change-over switch 91R of the right lock lever 89R, and is also configured to output control signals S2 to solenoids 20*b*, 20*c*, 12*b*, 12*c*, 10*b*, 10*c*, 19*b*, 19*c*, 21*b*, 21*c*, 43*b*, 43*c*, 66*b*, 66*c*, 71*b*, and 71*c* of the said electromagnetic valves 20B, 20C, 12B, 12C, 10B, 10C, 19B, 19C, 21B, 21C, 43B, 43C, 66B, 66C, 71B, and 71C.

That is, with the control mode of the controller 99 switched to a swing control mode from an angle control mode by actuating the change-over switch 88 as detailed later, as the left end portion or right end portion of the swing pedal 83 is stepped on to swing the swing pedal 83 either to the left-side down position or the right-side down position, the amount of operation (the operating angle) is detected by a position meter, or sensor, etc. A current or voltage of a magnitude proportional to the amount of the stepping operation is output to the controller 99 as the operation signal S1. The controller 99 then outputs the control signal S2 of a current or voltage proportional to the magnitude of the control signal S1 inputted from the swing pedal 83, to the solenoid 10*b* or 10*c* of the electromagnetic valve 10B for swinging to the left, or the electromagnetic valve 10C for swinging to the right. Thereby, the controller 99 controls the swing cylinder 10 to swing the implement 7 to the right or left at the speed corresponding to the amount of the stepping operation of the swing pedal 83 through the electromagnetic valve 10B for swinging to the left or the electromagnetic valve 10C for swinging to the right, and the swing cylinder control valve 10A. More specifically, when the swing pedal 83 is pivoted from the neutral position to the left-side down position, a control signal S2 of a magnitude corresponding to the amount of the operation is inputted to the solenoid 10*b* of the electromagnetic valve 10B for swinging to the left. This causes the electromagnetic valve 10B for swinging to the left to open to an extent corresponding to the amount of the operation of the swing pedal 83 to a left-side down position. As a result, the pilot pressure of the control valve 10A for the swing cylinder is controlled, and the swivel base 6 swings to the left at a speed proportional to the amount of operation of the swing pedal 83 to the left-side down position. As the swing pedal 83 is pivoted from the neutral position to the right-side down position, a control signal S2 of a magnitude corresponding to the amount of operation is inputted to the solenoid 10*c* of the electromagnetic valve 10C for swinging to the right. This causes the electromagnetic valve 10C for swinging to the right to open to an extent corresponding to the amount of the operation of the swing pedal 83 to a right-side down position. As a result, the pilot pressure of the control valve 10A for the swing cylinder is controlled, and the implement 7 swings to the right at a speed proportional to the amount of operation of the swing pedal 83 to the right-side down position. Therefore, a swing control means for actuating the swing cylinder 10 to swing the implement 7 to the right and left in correlation with the pedal operation of the swing pedal 83 includes a part of the controller 99, the electromagnetic valve 10B for swinging to the left, the electromagnetic valve 10C for swinging to the right, and the control valve 10A for the swing cylinder.

The boom and bucket control lever 86, when pivoted from the neutral position to a forward or rearward position, detects an amount of this operation (or the operating angle) by a position meter, or sensor, etc. and outputs to the controller 99 a current or voltage of a magnitude proportional to the amount of the forward or rearward operation, as an operation signal S1. The controller 99 outputs the control signal S2 of a current or voltage proportional to the magnitude of the operation signal S1 inputted from the boom and bucket control lever 86 to the solenoid 19*b* or 19*c* of the electromagnetic valve 19B for raising the boom, or the electromagnetic valve 19C for lowering the boom. Thereby, the controller 99 controls the boom cylinder 19 to pivot the boom 15 vertically at a speed corresponding to the amount of forward and rearward operation (i.e. in the fore-and-aft direction) of the boom and bucket control lever 86 through the electromagnetic valve 19B for raising the boom, or the electromagnetic valve 19C for lowering the boom, and the control valve 19A for the boom cylinder. More specifically, when the boom and bucket control lever 86 is pivoted forwardly from the neutral position, a control signal S2 of the magnitude corresponding to the amount of the lever operation is inputted to the solenoid 19*b* of the electromagnetic valve 19B for lowering the boom. This causes the electromagnetic valve 19B for lowering the boom to open to an extent corresponding to the amount of the forward operation of the boom and bucket control lever 86. As a result, the pilot pressure of the control valve 19A for the boom cylinder is controlled, and the boom 15 is lowered at a speed proportional to the amount of the forward lever operation of the boom and bucket control lever 86. When the boom and bucket control lever 86 is pivoted rearwardly from the neutral position, a control signal S2 of the magnitude corresponding to the amount of the operation is inputted to the solenoid 19*c* of the electromagnetic valve 19C for raising the boom. The electromagnetic valve 19B for raising the boom then opens to an extent corresponding to the amount of the rearward operation or manipulation of the boom and bucket control lever 86. As a result, the pilot pressure of the control valve 19A for the boom cylinder is controlled, and the boom 15 is raised at a speed proportional to the amount of the rearward operation or manipulation of the boom and bucket control lever 86.

The boom and bucket control lever 86, when pivoted from the neutral position to the right or left, detects an amount of this operation (or the operating angle) by a position meter, or sensor, etc. and outputs to the controller 99 a current or voltage of a magnitude proportional to the amount of the operation to the right or left, as an operation signal S1. The controller 99 outputs the control signal S2 of a current or voltage proportional to the magnitude of the operation signal S1 inputted from the boom and bucket control lever 86 to the solenoid 21*b* or 21*c* of the electromagnetic valve 21B for a bucket scooping, or the electromagnetic valve 21C for a bucket dumping. Thereby, the controller 99 controls the bucket cylinder 21 to cause the bucket 17 to perform a scooping or dumping at a speed corresponding to the amount of the operation of the boom and bucket control lever 86 to the right or left through the electromagnetic valve 21B for a bucket scooping, or the electromagnetic valve 21C for a bucket dumping, and the control valve 21A for the bucket cylinder. More specifically, when the boom and bucket control lever 86 is pivoted to the left from the neutral position, a control signal S2 of the magnitude corresponding to the amount of the lever operation is inputted to the solenoid 21*b* of the electromagnetic valve 21B for a bucket scooping. This causes the electromagnetic valve 21B for a bucket scooping to open to an extent corresponding to the amount of the lever operation of the boom and bucket control lever 86 to the left. As a result, the pilot pressure of the control valve 21A for the bucket cylinder is controlled, and the bucket 17 is caused to perform a scooping operation at a speed proportional to the amount of the lever operation of the boom and bucket control lever 86 to the left. When the boom and bucket control lever 86 is pivoted to the right from the neutral position, a control signal S2 of the magnitude corresponding to the amount of the lever operation is inputted to the solenoid 21*c* of the electromagnetic valve 21C for a bucket dump. This causes the electromagnetic valve 21C for a bucket dump to open to an extent corresponding to the amount of the operation of the boom and bucket control lever 86 to the right. As a result, the pilot pressure of the control valve 29A for the bucket cylinder is controlled, and the bucket 17 is caused to perform a dumping action at a speed proportional to the amount of the lever operation of the boom and bucket control lever 86 to the right.

The swing and arm control lever 90, when pivoted from the neutral position to a forward or rearward position, detects an amount of this operation (or the operating angle) by a position meter, or sensor, etc. and outputs to the controller 99 a current or voltage of a magnitude proportional to the amount of the forward or rearward lever operation, as an operation signal S1. The controller 99 outputs a control signal S2 of a current or voltage proportional to the magnitude of the operation signal S1 inputted from the swing and arm control lever 90 to the solenoid 20*b* or 20*c* of the electromagnetic valve 20B for pivoting the arm forward, or the electromagnetic valve 20C for pivoting the arm rearward. Thereby, the controller 99 controls the arm cylinder 20 to pivot the arm 16 forwardly or rearwardly at a speed corresponding to the amount of forward and rearward operation of the swing and arm control lever 90 through the electromagnetic valve 20B for pivoting the arm forward, or the electromagnetic valve 20C for pivoting the arm rearward, and the control valve 20A for the arm cylinder. More specifically, when the swing and arm control lever 90 is pivoted forwardly from the neutral position, a control signal S2 of the magnitude corresponding to the amount of the lever operation is inputted to the solenoid 20*b* of the electromagnetic valve 20B for pivoting the arm forward. This causes the arm 16 to pivot forward at a speed corresponding to the amount of the forward operation of the swing and arm control lever 90. When the swing and arm control lever 90 is pivoted rearwardly from the neutral position, a control signal S2 of the magnitude corresponding to the amount of the lever operation is inputted to the solenoid 20*c* of the electromagnetic valve 20C for pivoting the arm rearward. This causes the arm 16 to pivot rearward at a speed corresponding to the amount of the rearward operation of the swing and arm control lever 90.

The swing and arm control lever 90, when pivoted from the neutral position to the right or left, detects an amount of this operation (or the operating angle) by a position meter, or sensor, etc. and outputs to the controller 99 a current or voltage of a magnitude proportional to the amount of the lever operation to the right or left, as an operation signal S1. The controller 99 outputs the control signal S2 of a current or voltage proportional to the magnitude of the operation signal S1 inputted from the swing and arm control lever 90 to the solenoid 12*b* or 12*c* of the electromagnetic valve 12B for swinging to the left, or the electromagnetic valve 12C for swinging to the right. Thereby, the controller 99 controls the swing motor 12 to swing the swivel base 6 to the right or left at a speed, corresponding to the amount of operation of the swing and arm control lever 90 to the right or left through the electromagnetic valve 12B for swinging to the left, or the electromagnetic valve 12C for swinging to the right, and the control valve 12A for the swing motor. More specifically, when the swing and arm control lever 90 is pivoted to the left from the neutral position, a control signal S2 of the magnitude corresponding to the amount of the lever operation is inputted to the solenoid 12*b* of the electromagnetic valve 12B for swinging to the left. This causes the swivel base 6 to swing to the left at a speed corresponding to the amount of the operation of the swing and arm control lever 90 to the left. When the swing and arm control lever 90 is pivoted to the right from the neutral position, a control signal S2 of the magnitude corresponding to the amount of the lever operation is inputted to the solenoid 12*c* of the electromagnetic valve 12C for swinging to the right. This causes the swivel base 6 to swing to the right at a speed corresponding to the amount of the operation of the swing and arm control lever 90 to the right.

The dozer lever 87, when pivoted forwardly or rearwardly from the neutral position, detects this amount of operation (or the operating angle) by means of a position meter, or sensor, etc., and outputs to the controller 99 a current or voltage of a magnitude proportional to the amount of the forward or rearward lever operation, as an operation signal S1. The controller 99 outputs the control signal S2 of a current or voltage proportional to the magnitude of the operation signal S1 inputted from the dozer lever 87 to the solenoid 43*b* or 43*c* of the electromagnetic valve 43B for raising the dozer, or the electromagnetic valve 43C for lowering the dozer. Thereby, the controller 99 controls the dozer cylinder 43 to pivot the pivot support 31 vertically at a speed corresponding to the amount of forward and rearward operation of the dozer lever 87 through the electromagnetic valve 43B for raising the dozer, or the electromagnetic valve 43C for lowering the dozer, and the control valve 43A for the dozer cylinder. More specifically, when the dozer lever 87 is pivoted rearwardly from the neutral position, a control signal S2 of the magnitude corresponding to the amount of the lever operation is inputted to the solenoid 43*b* of the electromagnetic valve 43B for raising the dozer. This causes the pivot support 31 to be raised at a speed corresponding to the amount of the rearward operation of the dozer lever 87. When the dozer lever 87 is pivoted forwardly from the neutral position, a control signal S2 of the magnitude corresponding to the amount of the lever operation is inputted to the solenoid 43*c* of the electromagnetic valve 43C for lowering the dozer. This causes the pivot support 31 to be lowered at a speed corresponding to the amount of the forward operation of the dozer lever 87. Therefore, dozer control means for extending and retracting the dozer cylinder 43 to vertically pivot the pivot support 31 in correlation with the operation of the dozer lever 87 includes a part of the controller 99, the electromagnetic valve 43B for raising the dozer, the electromagnetic valve 43C for lowering the dozer, and the control valve 43A for dozer cylinder.

The tilt control member 92 of the dozer lever 87, when pivoted from the neutral position to the right or left by depressing the right or left hand portion of the member 92, detects the amount of his operation (or the operating angle) by a position meter, or sensor, etc. and outputs to the controller 99 a current or voltage of a magnitude proportional to the amount of the operation to the right or left, as an operation signal S1. The controller 99 outputs the control signal S2 of a current or voltage proportional to the magnitude of the operation signal S1 inputted from the tilt control member 92 to the solenoid 71*b* or 71*c* of the electromagnetic valve 71B for pivoting the blade to a left-side up position, or the electromagnetic valve 71C for pivoting the blade to a right-side up position. Thereby, the controller 99 controls the tilt cylinder 71 to pivot the blade 30 to a left-side up position or to a right-side up position about the tilt pivot shafts (or shaft) 50 at a speed corresponding to the amount of the operation of the tilt control member 92 to the right or left through the electromagnetic valve 71B for pivoting the blade to a left-side up position, or the electromagnetic valve 71C for pivoting the blade to a right-side up position, and the control valve 19A for the tilt cylinder. More specifically, when the tilt control member 92 is pressed down to pivot it to the left from the neutral position, a control signal S2 of the magnitude corresponding to the amount of the pivoting operation is inputted to the solenoid 71*b* of the electromagnetic valve 71B for pivoting the blade to a left-side up position. This causes the blade 30 to pivot to a left-side up position about the tilt pivot shafts (or shaft) 50 at a speed corresponding to the amount of the operation of the tilt control member 92 to a left-side up position. When the tilt control member 92 is pressed down to pivot it to a right-side up position from the neutral position, a control signal S2 of the magnitude corresponding to the amount of the operation is inputted to the solenoid 71*c* of the electromagnetic valve 71C for pivoting the blade to a right-side up position. This causes the blade 30 to pivot to a right-side up position about the tilt pivot shafts (or shaft) 50 at a speed corresponding to the amount of the operation of the tilt control member 92 to the right. Therefore, tilt control means for extending and retracting the tilt cylinder 71 to pivot the blade 30 about the tilt pivot shafts (or shaft) 50 in correlation with the actuation of the tilt control member 92 includes a part of the controller 99, the electromagnetic valve 71B for pivoting the blade to a left-side up position, the electromagnetic valve 71C for pivoting the blade to a right-side up position, and the control valve 71A for the tilt cylinder.

In addition, with the control mode of the controller 99 switched from a swing control mode, detailed later, to an angle control mode by actuating the change-over switch 88, as the left end portion or right end portion of the swing pedal 83 is stepped on to pivot the swing pedal 83 either to the left-side down position or to the right-side down position, the amount of operation (the operating angle) is detected by a position meter, or sensor, etc., a current or voltage of a magnitude proportional to the amount of the stepping operation is output to the controller 99 as the operation signal S1. The controller 99 then outputs the control signal S2 of a current or voltage proportional to the magnitude of the control signal S1 inputted from the swing pedal 83, to the solenoid 66*b* or 66*c* of the electromagnetic valve 66B for pivoting the blade to the left, or the electromagnetic valve 66C for pivoting the blade to the right. Thereby, the controller 99 controls the angle cylinder 66 to pivot the blade 30 about the angle pivot shaft 49 at a speed corresponding to the amount of the stepping operation of the swing pedal 83 through the electromagnetic valve 66B for pivoting the blade to the left or the electromagnetic valve 66C for pivoting the blade to the right, and the angle cylinder control valve 66A. More specifically, when the swing pedal 83 is pivoted to a left-side down position from the neutral position, a control signal S2 of the magnitude corresponding to the amount of the operation is inputted to the solenoid 66*b* of the electromagnetic valve 66B for pivoting the blade to the left. This causes the electromagnetic valve 66B for pivoting the blade to the left to open to an extent corresponding to the amount of the operation of the swing pedal 83 to a left-side down position. As a result, the pilot pressure of the control valve 66A for the angle cylinder is controlled, and the blade 30 pivots to the left about the angle pivot shaft 49 at a speed proportional to the amount of operation of the swing pedal 83 to the left-side down position. When the swing pedal 83 is pivoted to a right-side down position from the neutral position, a control signal S2 of the magnitude corresponding to the amount of the pivoting operation is inputted to the solenoid 66*c* of the electromagnetic valve 66C for pivoting the blade to the right. This causes the electromagnetic valve 66C for pivoting the blade to the right to open to an extent corresponding to the amount of the operation of the swing pedal 83 to the right-side down position. As a result, the pilot pressure of the control valve 66A for the angle cylinder is controlled, and the blade 30 pivots to the right about the angle pivot shaft 49 at a speed proportional to the amount of operation of the swing pedal 83 to the right-side down position. Therefore, angle control means for controlling the angle cylinder 66 to pivot the blade 30 to the right or left about the angle pivot shaft 49 in correlation with the stepping operation of the swing pedal 83 includes a part of the controller 99, the electromagnetic valve 66B for pivoting the blade to the left, the electromagnetic valve 66C for pivoting the blade to the right, and the control valve 66A for the angle cylinder.

A switchover signal from the change-over switch 88 is inputted into the controller 99. And whenever the switchover signal of the change-over switch 88 is input to the controller 99, the controller 99 switches between an angle control mode in which the angle cylinder 66 is controlled by the angle control means in correlation with the pedal operation of the swing pedal 83, and an swing control mode in which the swing cylinder 10 is controlled by the swing control means in correlation with the pedal operation of the swing pedal 83. That is, the control mode of the controller 99 is switched between the swing control mode and the angle control mode for every switching operation of the change-over switch 88. When the swing control mode is selected by a switching operation of the change-over switch 88, a control signal S2 of a current or voltage proportional to the magnitude of the stepping operation of the swing pedal 83 is input to the solenoid 10*b* or 10*c* of the electromagnetic valve 10B for swinging to the left, or the electromagnetic valve 10C for swinging to the right as described above. Thereby, the swing cylinder 10 is controlled to swing the implement 7 to the right or left at a speed corresponding to the amount of the stepping operation of the swing pedal 83. Similarly, when the angle control mode is selected by a switching operation of the change-over switch 88, a control signal S2 of a current or voltage proportional to the magnitude of the stepping operation of the swing pedal 83 is input to the solenoid 66*b* or 66*c* of the electromagnetic valve 66B for pivoting the blade to the left, or the electromagnetic valve 10C for pivoting the blade to the right as described above. Thereby, the angle cylinder 66 is controlled to pivot the blade 30 to the right or left at a speed corresponding to the amount of the stepping operation of the swing pedal 83. Therefore, the system is configured, by selectively applying a pilot pressure either to the control valve 10A for swinging or to the control valve 71A for the angle cylinder, to selectively perform either the angle control operation in which the blade 30 is pivoted about the angle pivot shaft 49 in correlation with the pedal operation of the swing pedal 83, or the swing operation of the implement 7 to the right or left in correlation with the amount of operation of the swing operating member 83. The mode change-over means, for switching between the angle control mode in which the angle cylinder 66 is controlled by the angle control means in correlation with a pedal operation of the swing pedal 83 and the swing control mode in which the swing cylinder 10 is controlled by the swing control means in correlation with the pedal operation of the swing pedal 83, includes the change-over switch 88, a part of the controller 99, the electromagnetic valve 10B for swinging to the left, the electromagnetic valve 10C for swinging to the right, the control valve 10A for the swing cylinder, the electromagnetic valve 66B for pivoting the blade to the left, the electromagnetic valve 66C for pivoting the blade to the right, and the control valve 66A for the angle cylinder.

The switchover signal (raised state detection signal) of the change-over switches 91L and 91R of the right and left lock levers 89R and 89L is inputted to the controller 99. When the switchover signal (raised state detection signal) from the change-over switch 91L is inputted to the controller 99, the controller 99 discontinues the output of the control signal S2 to the solenoid 12*b* and 12*c* of the electromagnetic valve 12B for swinging to the left, and the electromagnetic valve 12C for swinging to the right, the output of the control signal S2 to the solenoid 19*b* and 19*c* of the electromagnetic valve 19B for raising the boom, and the electromagnetic valve 19C for lowering the boom, the output of the control signal S2 to the solenoid 21*b* and 21*c* of the electromagnetic valve 21B for a bucket scooping, and the electromagnetic valve 21C for a bucket dump, and the output of the control signal S2 to the solenoid 20*b* and 20*c* of the electromagnetic valve 20B for a forward pivoting, and the electromagnetic valve 20C for a rearward pivoting. Thus, by an upward operation of the left lock lever 89L (i.e. by raising or lifting the lever), manipulations of the boom 15 and the bucket 17 by the boom and bucket control lever 86 are disabled, and swing manipulations of the swivel base 6 and manipulations of the arm 16 by the swing and arm control lever 90 are disabled.

Similarly, when the switchover signal (raised state detection signal) from the change-over switch 91R is inputted into the controller 99, the controller 99 discontinues the output of the control signal S2 to the solenoid 12*b* and 12*c* of the electromagnetic valve 12B for swinging to the left, and the electromagnetic valve 12C for swinging to the right, the output of the control signal S2 to the solenoid 19*b* and 19*c* of the electromagnetic valve 19B for raising the boom, and the electromagnetic valve 19C for lowering the boom, the output of the control signal S2 to the solenoid 21*b* and 21*c* of the electromagnetic valve 21B for a bucket scooping, and the electromagnetic valve 21C for a bucket dump, and the output of the control signal S2 to the solenoid 20*b* and 20*c* of the electromagnetic valve 20B for a forward swing, and the electromagnetic valve 20C for a rearward swing. Thus, by an upward operation of the right lock lever 89R, swing operations of the swivel base 6 and the operation of the arm 16 by the swing and arm control lever 86 are disabled, and manipulations of the boom 15 and the bucket 17 by the boom and bucket control lever 86 are disabled.

The above right and left lock levers 89R and 89L define a lever lock mechanism 93, which places the backhoe 1 in a halt condition, together with the change-over switches 91R and 91L, a part of the controller 99, the electromagnetic valve 12B for swinging to the left, the electromagnetic valve 12C for swinging to the right, the electromagnetic valve 19B for raising the boom, the electromagnetic valve 19C for lowering the boom, the electromagnetic valve 21B for a bucket scooping, the electromagnetic valve 21C for a bucket dumping, the electromagnetic valve 10B for swinging to the left, the electromagnetic valve 10C for swinging to the right, the electromagnetic valve 20B for pivoting the arm forwardly, the electromagnetic valve 20C for pivoting the arm rearwardly, etc.

When both the left lock lever 89L and the right lock lever 89R are lowered, manipulations of the boom 15 and the bucket 17 by the boom and bucket control lever 86 are enabled, and manipulations of the swivel base 6 and the arm 16 by the swing and arm control lever 90 are enabled.

Therefore, the lever lock mechanism 93 can be switched between an ON state and an OFF state. And when the right and left lock levers 89R and 89L are both lowered, the lever lock mechanism 93 is placed in the ON state, the swing operations of all the boom 15, the arm 16, the bucket 17, and the swivel base 6 by the boom and bucket control lever 86, and the swing and arm control lever 90 are enabled to perform work operations. When both or either one of the right and left lock lever 89R and 89L are/is lowered, the lever look mechanism 93 is placed in the OFF state. Even if the boom and bucket control lever 86 or, the swing and arm control lever 90 is manipulated, the swing operations of the boom 15, the arm 16, the bucket 17, and the swivel base 6 are disabled to render work operations impossible to perform.

Further, when both or either one of the right and left look lever 89R and 89L are/is raised (i.e. when the lever lock mechanism 93 placed in the OFF state), the controller 99 discontinues the output of the control signal S2 to the solenoid 43*b* and 43*c* of the electromagnetic valve 43B for raising the dozer, and the electromagnetic valve 43C for lowering the dozer, the output of the control signal S2 to the solenoid 66*b* and 66*c* of the electromagnetic valve 66B for pivoting the blade to the left, and the electromagnetic valve 66C for pivoting the blade to the right, the output of the control signal S2 to the solenoid 10*b* and 10*c* of the electromagnetic valve 10B for swinging to the left, and the electromagnetic valve 10C for swinging to the right, and the output of the control signal S2 to the solenoid 71*b* and 71*c* of the electromagnetic valve 71B for pivoting the blade to a left-side up position, and the electromagnetic valve 71C for pivoting the blade to a right-side up position. With this configuration, the controller 99 is configured to halt pivot operations of the pivot support 31, right and left pivot operations about the angle pivot shaft 49 of the blade 30, right and left swing operations of the swivel base 6, and vertical pivot operations about the tilt pivot shafts 50 of the blade 30. Therefore, operation disabling means for disabling extending and retracting operations of the dozer cylinder 43 by the dozer lever 87, for disabling extending and retracting operations of the tilt cylinder 71 by the tilt control member 92, and for disabling operations of the swing cylinder 10 and extending and retracting operations of the angle cylinder 66 by the swing pedal 83 when the lever lock mechanism 93 is in the OFF state, includes a part of the controller 99, the electromagnetic valve 43B for raising the dozer, the electromagnetic valve 43C for lowering the dozer, the control valve 43A for the dozer cylinder, the electromagnetic valve 66B for pivoting the blade to the left, the electromagnetic valve 66C for pivoting the blade to the right, the control valve 66A for the angle cylinder, the electromagnetic valve 10B for swinging to the left, the electromagnetic valve 10C for swinging to the right, the control valve 10A for the swing cylinder, the electromagnetic valve 71B for pivoting the blade to a left-side up position, the electromagnetic valve 71C for pivoting the blade to the right-side up position, and the control valve 71A for the tilt cylinder.

In the above-mentioned embodiment, a vertical pivoting of the parts including pivot support 31 and the dozer device 5 for a dozer operation etc., is accomplished by griping the grip 87*a* of the dozer lever 87 by hand, and simply pivoting the dozer lever 87 in the fore and aft direction. And pivoting of the dozer lever 87 forwardly or rearwardly (i.e. in the fore-and-aft direction) causes the controller 99 to control the dozer cylinder 43 to pivot the pivot support 31 vertically at a speed corresponding to the amount of forward and rearward operation of the dozer lever 87 through the electromagnetic valve 43B for raising the dozer, or the electromagnetic valve 43C for lowering the dozer, and the control valve 43A for the dozer cylinder, thus facilitating a vertical pivoting of the parts including pivot support 31 and the dozer device 5.

To vertically pivot the blade 30 about the tilt pivot shafts (or shaft) 50, one simply holds the grip 87*a* of the dozer lever 87 by hand and depresses the left-hand side or right-hand side of the tilt control member 92 with, for example, the thumb of the holding hand to pivot the tilt control member 92 to the right or left. And the pivoting of the tilt control member 92 to the right or left causes the controller 99 to control the tilt cylinder 71 to pivot the blade 30 to a left-side up position or a right-side up position at a speed corresponding to the amount of operation of the tilt control member 92 to the right or left through the electromagnetic valve 71B for pivoting the blade to a left-side up position, or the electromagnetic valve 71C for pivoting the blade to a right-side up position, and the control valve 71A for the tilt cylinder, thus facilitating a vertical pivoting of the blade 30 about the tilt pivot shafts (or shaft) 50.

To pivot the blade 30 to the right or left about the angle pivot shaft 49, one would simply switch the control mode from the swing control mode to the angle control mode by a switching operation of the change-over switch 88, and while in the angle control mode, step on the right or left end of the swing pedal 83 to pivot the swing pedal 83 to a left-side down position or a right-side down position. The pivoting of the swing pedal 83 causes the controller 99 to control the angle cylinder 66 to pivot the blade 30 to the right or left at a speed corresponding to the amount of the stepping operation of the swing pedal 83 through the electromagnetic valve 66B for pivoting the blade to the left or the electromagnetic valve 66C for pivoting the blade to the right, and the angle cylinder control valve 66A, thus facilitating pivoting of the blade 30 to the right or left about the angle pivot shaft 49.

And, to pivot the pivot support 31 of the dozer device 5 vertically and pivot the blade 30 vertically about the tilt pivot shafts (or shaft) 50 simultaneously, one simply holds the grip 87*a* of the dozer lever 87 and depresses the left-hand side or right-hand side of the tilt control member 92 with, for example, the thumb of the holding hand to pivot the tilt control member 92 to the right or left while pivoting the dozer lever 87 in the fore-and-aft direction, thus allowing and facilitating a vertical pivoting of the support 31 of the dozer device 5 and a vertical pivoting of the blade 30 about the tilt pivot shafts 50 simultaneously by a single hand.

In addition, to pivot the pivot support 31 of the dozer device 5 vertically and pivot the blade 30 to the right or left about the angle pivot shaft 49 simultaneously, one simply holds the grip 87*a* of the dozer lever 87 and steps on the left-hand end or right-hand end of the swing pedal 83 to pivot the swing pedal 83 to a left-side down position or a right-side down position while pivoting the dozer lever 87 in the fore-and-aft direction with the control mode switched from the swing control mode to the angle control mode, thus allowing and facilitating a vertical pivoting of the support 31 of the dozer device 5 and a pivoting of the blade 30 to the right or left about the angle pivot shaft 49 simultaneously by a single hand and a foot.

Also, to pivot the blade 30 vertically about the tilt pivot shafts (or shaft) 50 and pivot the blade 30 about the angle pivot shaft 49 to the right or left simultaneously, one simply holds the grip 87*a* of the dozer lever 87 and depresses the left-hand side or right-hand side of the tilt control member 92 with, for example, the thumb of the holding hand to pivot the tilt control member 92 to the right or left while stepping on the left-hand end or right-hand end of the swing pedal 83 to pivot the swing pedal 83 to a left-side down position or a right-side down position with the control mode switched from the swing control mode to the angle control mode, thus allowing and facilitating a vertical pivoting of the blade 30 about the tilt pivot shafts (or shaft) 50 and a pivoting of the blade 30, to the right or left about the angle pivot shaft 49 simultaneously by a single hand and a foot.

Also, to pivot the pivot support 31 of the dozer device 5 vertically, to pivot the blade 30 vertically about the tilt pivot shafts (or shaft) 50, and pivot the blade 30 about the angle pivot shaft 49 to the right or left simultaneously, one simply holds the grip 87*a* of the dozer lever 87 and depresses the left-hand side or right-hand side of the tilt control member 92 with, for example, the thumb of the holding hand to pivot the tilt control member 92 to the right or left while pivoting the dozer lever 87 in the fore-and-aft direction and while stepping on the left-hand end or right-hand end of the swing pedal 83 to pivot the swing pedal 83 to a left-side down position or a right-side down position with the control mode switched from the swing control mode to the angle control mode, thus allowing and facilitating a vertical pivoting of the pivot support 31 of the dozer device 5, a vertical pivoting of the blade 30 about the tilt pivot shafts 50 and a pivoting of the blade 30 to the right or left about the angle pivot shaft 49 simultaneously by a single hand and a foot.

And, when the left lock lever 89L or the right lock lever 89R is raised, this disables the swing operations of the boom 15, the arm 16, the bucket 17, and the swivel base 6 by the boom and bucket control lever 86 and the swing and arm control lever 90 rendering the implement 7 inoperative, as well as vertical pivoting of the pivot support 31 of the dozer device 5 by a vertical pivoting of the dozer lever 87 operation, vertical pivoting about the tilt pivot shafts (or shaft) 50 of the blade 30 by the tilt control member 92, the swing operation of the implement 7 by stepping on the swing pedal 83, and pivoting of the blade 30 about the angle pivot shaft 49. This can prevent unintentional movements of the dozer device 5 and the implement 7 caused by accidentally touching the dozer lever 87, the tilt control member 92 of the dozer lever 87, or the swing pedal 83 when the operator gets on or off the swivel work machine 1.

Because there are provided the tilt control member 92 in the dozer operation implement 87; the tilt control means for extending and retracting the tilt cylinder 71 to pivot the blade 30 about the tilt pivot shafts (or shaft) 50 in correlation with a manipulation of the tilt control member 92; the angle control means for controlling the angle cylinder to pivot the blade 30 about the angle pivot shaft 49 in correlation with the pedal operation of the swing pedal 83; the mode change-over means for switching between the angle control mode in which the angle cylinder 66 is controlled in correlation with the pedal operation of the swing pedal 83, and the swing control mode in which the swing cylinder 10 is controlled in correlation with the operation of a swing control 83; and the swig control valve 10A corresponding to the swing cylinder 10 and the control valve 66A for the angle cylinder corresponding to the angle cylinder 66, and because it is configured, by selectively applying the pilot pressure either to the switch control valve 10A or to the control valve 71A for angle cylinder, to selectively perform either an angle control operation in which the blade 30 is pivoted about the angle pivot shaft 49 in correlation with the operation of the swing pedal 83, or the swing operation in which the implement 7 is swung to the right or left in correlation with the operation of the swing control 83, it is possible very conveniently to pivot the blade 30 vertically about the tilt pivot shafts (or shaft) 50 and to the right or left about the angle pivot shaft 49 simultaneously using a single hand and a foot by performing a pedal operation of the swing pedal 83 while operating the tilt control member 92, with the control mode switched from the swing control mode to the angle control mode.

In addition, since a switching between swing operations of the implement 7 by stepping on the swing pedal 83, and pivoting of the blade 30 to the right or left about the angle pivot shaft 49 by stepping on the swing pedal 83 is done by the change-over switch 88, the swing operations of the implement 7 and pivoting of the blade 30 about the angle pivot shaft 49 cannot be performed simultaneously. However, since it is not necessary to perform a swing operation of the implement 7 and a pivoting of the blade 30 about the angle pivot shaft 49 simultaneously in an ordinary work operation, this results in no inconvenience in the work operation.

Figure 12:
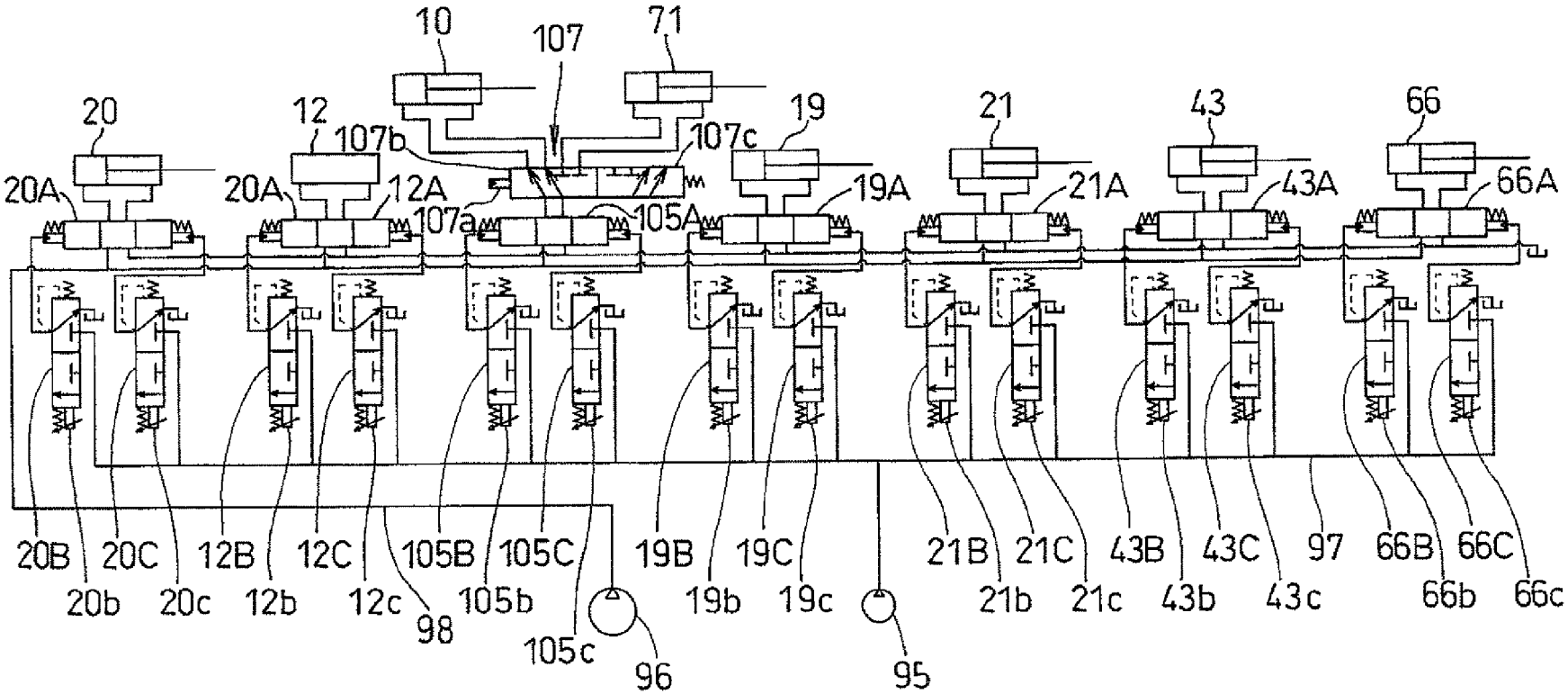
FIG. 12 shows a hydraulic circuit in a different embodiment.
Figure 13:
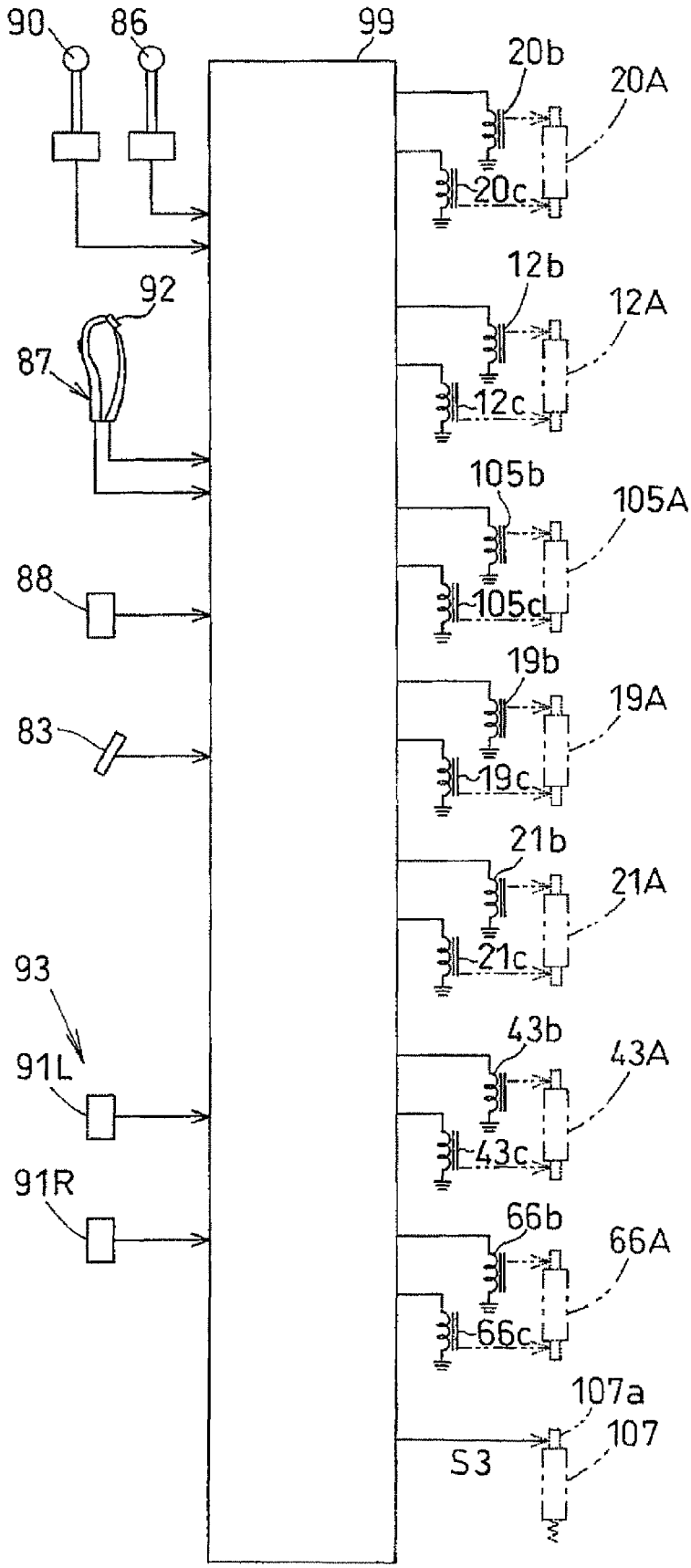
FIG. 13 shows a schematic view of an electrical-control system of the different embodiment.

The embodiment of the FIGS. 1-11 is provided with the swing pedal 83, the dozer lever 87, and the tilt control member 92 provided to the dozer lever 87, wherein the implement 7 is swung to the right or left in correlation with the pedal operation of the swing pedal 83, and the pivot support 31 is pivoted vertically in correlation with the operation of the dozer lever 87, and the blade 30 is pivoted about the tilt pivot shafts (or shaft) 50 in correlation with an operation of the tilt control member 92, wherein the swing control valve 10A corresponding to the swing cylinder 10 and the control valve 66A for the angle cylinder corresponding to the angle cylinder 66 are provided, and wherein, it is configured, by selectively directing the pilot pressure either to the swing control valve 10A or to the control valve 71A for the angle cylinder, to perform either the angle control operation in which the blade 30 is pivoted about the angle pivot shaft 49 in correlation with the operation of the swing control 83, or the swing control operation in which the implement 7 is swung to the right or left in correlation with the operation of the swing control 83. Instead, an alternative configuration may be used, in which swing pedal 83 and the dozer lever 87 as well as an angle control member provided, for example, to the dozer lever 87 may be provided but without the tilt control member 92, wherein the implement 7 is pivoted to the right or left in correlation with the pedal operation of the swing pedal 83, and the pivot support 31 is pivoted vertically in correlation with an operation of the dozer lever 87, and the blade 30 is pivoted about the angle pivot shaft 49 in correlation with the operation of the angle control member, and wherein the swing control valve 10A corresponding to the swing cylinder 10 and the tilt cylinder control valve 71A corresponding to the tilt cylinder 71 are provided, and wherein the system may be configured, by selectively directing a pilot pressure either to the control valve 10A for swinging or the control valve 71A for the tilt cylinder, to perform either a tilt control operation in which the blade 30 is pivoted about the tilt pivot shafts (or shaft) 50 in correlation with the pedal operation of the swing pedal 83, or a swing operation in which the implement 7 is swung to the right or left in correlation with the operation of the swing control 83. In this case, with the control mode switched from the swing control mode to the tilt control mode, the blade 30 can be very conveniently and simultaneously pivoted vertically about the tilt pivot shaft 50 and to the right or left about the angle pivot shaft 49 with a single hand and a foot by manipulating the angle control member while stepping on the swing pedal 83, FIGS. 12 and 13 show a different embodiment. The seesaw switch provided to the dozer lever 87 shown in FIG. 13, in lieu of the tilt control member 92 in the embodiment described above, functions as an angle control member 103. When the angle control member 103 is pivoted to the right or left from the neutral position by pressing on the left-hand side or right-hand side of the angle control member 103, the amount of operation (or the operating angle) is detected by means of a position meter, or sensor, etc., and a current or voltage of a magnitude proportional to the amount of the operation to the right or left is output to the controller 99 as an operation signal S1. The controller 99 outputs the control signal S2 of a current or voltage proportional to the magnitude of the operation signal S1 inputted from the dozer lever 87 to the solenoid 66*b* or 66*c* of the electromagnetic valve 66B for pivoting the blade to the left, or the electromagnetic valve 66C for pivoting the blade to the right. Thereby, the controller 99 controls the angle cylinder 66 to pivot the blade 30 about the angle pivot shaft 49 at a speed corresponding to the amount of the operation to the right or left of the angle control member 103 through the electromagnetic valve 66B for pivoting the blade to the left or the electromagnetic valve 66C for pivoting the blade to the night, and the angle cylinder control valve 66A. More specifically, when the angle control member 103 is pivoted to a left-side up position from the neutral position by pressing down on the control 103, a control signal S2 of the magnitude corresponding to the amount of the operation is inputted to the solenoid 66*b* of the electromagnetic valve 66B for pivoting the blade to the left. This causes the electromagnetic valve 66B for pivoting the blade to the left to open to an extent corresponding to the amount of the operation of the angle control member 103 to the left-side up position. As a result, the pilot pressure of the control valve 66A for the angle cylinder is controlled, and the blade 30 pivots to the left about the angle pivot shaft 49 at a speed proportional to the amount of operation of the angle control member 103 to the left-side up position. When the angle control member 103 is pivoted to a right-side up position from the neutral position by pressing down on the angle control member 103, a control signal S2 of the magnitude corresponding to the amount of the operation is inputted to the solenoid 66*c* of the electromagnetic valve 66C for pivoting the blade to the right. This causes the electromagnetic valve 66C for pivoting the blade to the right to open to an extent corresponding to the amount of the operation of the angle control member 103 to the right-side up position. As a result, the pilot pressure of the control valve 66A for the angle cylinder is controlled, and the blade 30 pivots to the right about the angle pivot shaft 49 at a speed proportional to the amount of operation of the angle control member 103 to the left-side up position. Therefore, angle control means for actuating the angle cylinder 66 to pivot the blade 30 to the right or left about the angle pivot shaft 49 in correlation with the operation of the angle control member 103 includes a part of the controller 99, the electromagnetic valve 66B for pivoting the blade to the left, the electromagnetic valve 66C for pivoting the blade to the right, and the control valve 66A for the angle cylinder.

In addition, as shown in FIG. 12, in lieu of the control valve 10A for the swing cylinder, the control valve 71A for the tilt cylinder, the electromagnetic valve 10B for swinging to the left, the electromagnetic valve 10C for swinging to the right, the electromagnetic valve 71B for pivoting the blade to a left-side up position, and the electromagnetic valve 71C for pivoting the blade to a right-side up position in the embodiment described above, there are provided a control valve 105A for the swing cylinder and the tilt cylinder, an electromagnetic valve 105B for swinging to the left and pivoting the blade a left-side down position, which has a solenoid 105*b*, and an electromagnetic valve 105C for swinging to the right and pivoting the blade to a right-side down position, which has a solenoid 105*c*. And a directional control valve 107 is provided between (a) the swing cylinder 10 and the tilt cylinder 71 on the one hand, and (b) the control valve 105A for the swing cylinder and the tilt cylinder on the other.

And, whenever the controller 99 receives a change-over signal of the change-over switch 88, it turns on or turns off the output of the switchover signal S3 to the solenoid 107*a* of the directional control valve 107. This causes a switching between a tilt control mode in which the tilt cylinder 71 is controlled by the tilt control means in correlation with the pedal operation of the swing pedal 83, and a swing control mode in which the swing cylinder 10 is controlled by the swing control means in correlation with the pedal operation of the swing pedal 83. In other words, the directional control valve 107 is configured to be switchable between a swing cylinder actuating position 107*b* and a tilt-cylinder actuating position 107*c* and whenever the switchover signal of the change-over switch 88 is input into the controller 99, the directional control valve 107 is switched to the swing cylinder actuating position 107*b* and to the tilt-cylinder actuating position 107*c* in turn. And, when the swing pedal 83 is pivoted to a left-side down position or a right-side down position by stepping on the left end portion or right end portion of the swing pedal 83, the amount of this operation (or the operating angle) is detected by a position meter, or sensor, etc., and a current or voltage of a magnitude proportional to the amount of the stepping operation is output to the controller 99 as the operation signal S1. The controller 99 then outputs the control signal S2 of a current or voltage proportional to the magnitude of the control signal S1 inputted from the swing pedal 83, to the solenoid 105*b* or 105*c* of the electromagnetic valve 105B for swinging to the left and pivoting the blade to a left-side down position, or the electromagnetic valve 105C for swinging to the right and pivoting the blade to a right-side down position. Thereby, the controller 99 controls the swing cylinder 10 to swing the implement 7 to the right or left at the speed corresponding to the amount of the stepping operation of the swing pedal 83 or controls the tilt cylinder 71 to pivot the blade 30 vertically about the tilt pivot shafts (or shaft) 50 through the electromagnetic valve 105B for swinging to the left and pivoting the blade to a left-side down position, or the electromagnetic valve 105C for swinging to the right and pivoting the blade to a right-side down position, and the control valve 105A for the swing cylinder and the tilt cylinder.

More specifically, when the swing pedal 83 is pivoted to a left-side down position from the neutral position with the directional control valve 107 switched to the swing cylinder actuating position 107*b*, a control signal S2 of the magnitude corresponding to the amount of the operation is inputted to the solenoid 105*b* of the electromagnetic valve 105B for swinging to the left and pivoting the blade to a left-side down position. This causes the electromagnetic valve 105B for swinging to the left and pivoting the blade to a left-side down position to open to an extent corresponding to the amount of the operation of the swing pedal 83 to the left-side down position. As a result, the pilot pressure of the control valve 105A for the swing cylinder and the tilt cylinder is controlled, and the implement 7 swings to the left at a speed proportional to the amount of operation of the swing pedal 83 to a left-side down position. When the swing pedal 83 is pivoted to a right-side down position from the neutral position with the directional control valve 107 switched to the swing cylinder actuating position 107*b*, a control signal S2 of the magnitude corresponding to the amount of the operation is inputted to the solenoid 105*c* of the electromagnetic valve 105C for swinging to the right and pivoting the blade to a right-side down position. This causes the electromagnetic valve 105C for swinging to the right and pivoting the blade to a right-side down position to open to an extent corresponding to the amount of the operation of the swing pedal 83 to the right-side down position. As a result, the pilot pressure of the control valve 105A for the swing cylinder and the tilt cylinder is controlled, and the implement 7 swings to the right at a speed proportional to the amount of operation of the swing pedal 83 to a right-side down position. Therefore, swing control means for controlling the swing cylinder 10 to pivot the implement 7 to the right or left in correlation with the stepping operation of the swing pedal 83 includes a part of the controller 99, the electromagnetic valve 105B for swinging to the left and pivoting the blade to a left-side down position, the electromagnetic valve 105C for swinging to the right and pivoting the blade to a right-side down position, the control valve 105A for the swing cylinder and the tilt cylinder.

And, when the swing pedal 83 is pivoted to a left-side down position from the neutral position with the directional control valve 107 switched to the tilt cylinder actuating position 107*c*, a control signal S2 of the magnitude corresponding to the amount of the operation is inputted to the solenoid 105*b* of the electromagnetic valve 105B for swinging to the left and pivoting the blade to a left-side down position. This causes the electromagnetic valve 105B for swinging to the left and pivoting the blade to a left-side down position to open to an extent corresponding to the amount of the operation of the swing pedal 83 to the left-side down position. As a result, the pilot pressure of the control valve 105A for the swing cylinder and the tilt cylinder is controlled, and the blade 30 pivots to a left-side down position about the tilt pivot shafts (or shaft) 50 at a speed proportional to the amount of operation of the swing pedal 83 to the left-side down position.

When the swing pedal 83 is pivoted to a right-side down position from the neutral position with the directional control valve 107 switched to the tilt cylinder actuating position 107*c*, a control signal S2 of the magnitude corresponding to the amount of the operation is inputted to the solenoid 105*c* of the electromagnetic valve 105C for swinging to the right and pivoting the blade to a right-side down position. This causes the electromagnetic valve 105C for swinging to the right and pivoting the blade to a right-side down position to open to an extent corresponding to the amount of the operation of the swing pedal 83 to the right-side down position. As a result, the pilot pressure of the control valve 105A for the swing cylinder and the tilt cylinder is controlled, and the blade 30 pivots to a right-side down position about the tilt pivot shafts (or shaft) 50 at a speed proportional to the amount of operation of the swing pedal 83 to the right-side down position. Therefore, swing control means for controlling the tilt cylinder 71 to pivot the blade 30 vertically about the tilt pivot shafts (or shaft) 50 in correlation with the stepping operation of the swing pedal 83 includes a part of the controller 99, the electromagnetic valve 105B for swinging to the left and pivoting the blade to a left-side down position, the electromagnetic valve 105C for swinging to the right and pivoting the blade to a right-side down position, the control valve 105A for the swing cylinder and the tilt cylinder.

The other aspects of the present embodiment are of the same configurations as the previous embodiment. And When a switchover signal from either of the change-over switches 91L and 91R of the right or left lock lever 89L or 89R is inputted into the controller 99, the controller 99 discontinues the output of the control signal S2 to the solenoid 12*b* or 12*c* of the electromagnetic valve 12B for swinging to the left, or the electromagnetic valve 12C for swinging to the right, the output of the control signal S2 to the solenoid 19*b* or 19*c* of the electromagnetic valve 19B for rising the boom, or the electromagnetic valve 19C for lowering the blade, the output of the control signal S2 to the solenoid 21*b* or 21*c* of the electromagnetic valve 21B for a bucket scoop, or the electromagnetic valve 21C for a bucket dump, the output of the control signal S2 to the solenoid 10*b* or 10*c* of the electromagnetic valve 10B for swinging to the left, or the electromagnetic valve 10C for swinging to the right, the output of the control signal S2 to the solenoid 20*b* or 20*c* of the electromagnetic valve 20B for a forward pivoting, or the electromagnetic valve 20C for a rearward pivoting, as well as the output of the control signal S2 to the solenoid 43*b* or 43*c* of the electromagnetic valve 43B for rising the dozer, or the electromagnetic valve 43C for lowering the dozer, the output of the control signal S2 to the solenoid 66*b* or 66*c* of the electromagnetic valve 66B for pivoting the blade to the left, or the electromagnetic valve 66C for pivoting the blade to the right, the output of the control signal S2 to the solenoid 105*b* of the electromagnetic valve 105B for swinging to the left and pivoting the blade to a left-side down position, and the output of the control signal S2 to the solenoid 105*c* of the electromagnetic valve 105C for swinging to the right and pivoting the blade to a right-side down position. Thus, the system is configured such that an upward operation of either of the right or left lock lever 59L or 59R will disable operations of the boom 15 and the bucket 17 by the boom and bucket control lever 86, swing operations of the swivel base 6 and operations of the arm 16 by the swing and arm control lever 90, and will discontinue pivoting of the pivot support 31, pivoting of the blade 30 to the right or left about the angle pivot shaft 49, swinging of the implement 7 to the right or left, vertical pivoting of the blade 30 about the tilt pivot shafts (or shaft) 50.

According to the embodiment described above, to vertically pivot parts including the pivot support 31 and the dozer device 5 for a dozer work, etc., one simply holds the grip 87*a* of the dozer lever 87 by hand and pivot the dozer lever in the fore-and-aft direction. And with pivoting of the dozer lever 87 in the fore-and-aft direction, the controller 99 controls the dozer cylinder 43 to pivot the pivot support 31 vertically at a speed corresponding to the amount of forward and rearward operation of the dozer lever 87 through the electromagnetic valve 43B for raising the dozer, or the electromagnetic valve 43C for lowering the dozer, and the control valve 43A for the dozer cylinder, thus facilitating a simple vertical pivoting of the parts including pivot support 31 and the dozer device 5.

To pivot the blade 30 to the right or left about the angle pivot shaft 49, one simply holds the grip 87*a* of the dozer lever 87 by hand and depresses the left-hand side or right-hand side of the angle control member 103 with, for example, the thumb of the holding hand to pivot the angle control member 103 to the right or left. The pivoting of the angle control member 103 causes the controller 99 to control the angle cylinder 66 to pivot the blade 30 to the right or left at a speed corresponding to the amount of the operation of the angle control member 103 to the right or left through the electromagnetic valve 66B for pivoting the blade to the left or the electromagnetic valve 66C for pivoting the blade to the right, and the angle cylinder control valve 66A, thus facilitating pivoting operations of the blade 30 to the right or left about the angle pivot shaft 49.

To pivot the blade 30 about the tilt pivot shaft 50 to a left-side up position or a right-side up position, one would simply switch the control mode from the swing control mode to the tilt control mode by a switching operation of the change-over switch 88 (to switch the directional control valve 107 to the tilt cylinder actuating position 107*c*), and while in the tilt control mode, step on the right or left end of the swing pedal 83 to pivot the swing pedal 83 to a left-side down position or a right-side down position. The pivoting of the swing pedal 83 causes the controller 99 to control the tilt cylinder 71 to pivot the blade 30 to a left-side up position or a right-side up position at a speed corresponding to the amount of the stepping operation of the swing pedal 83 through the electromagnetic valve 105B for swinging to the left and pivoting the blade to a left-side down position or the electromagnetic valve 105C for swinging to the right and pivoting the blade to a right-side down position, and the control valve 105A for the swing cylinder and the tilt cylinder, thus facilitating pivoting of the blade 30 to a left-side up position or right-side up position about the tilt pivot shafts (or shaft) 50.

And, to pivot the pivot support 31 of the dozer device 5 vertically and pivot the blade 30 to the right or left about the angle pivot shaft 49 simultaneously, one simply holds the grip 87*a* of the dozer lever 87 and depresses the left-hand side or right-hand side of the angle control member 103 with, for example, the thumb of the holding hand to pivot the angle control element 103 to the right or left while pivoting the dozer lever 87 in the fore-and-aft direction, thus allowing and facilitating a vertical pivoting of the support 31 of the dozer device 5 and a pivoting of the blade 30 to the right or left about the angle pivot shaft 49 simultaneously by a single hand.

Also, to pivot the pivot support 31 of the dozer device 5 vertically and pivot the blade 30 vertically about the tilt pivot shafts (or shaft) 50 simultaneously, one simply holds the grip 87*a* of the dozer lever 87 by hand and steps on the left-hand end or right-hand end of the swing pedal 83 to pivot the swing pedal 83 to a left-side down position or a right-side down position while pivoting the dozer lever 87 in the fore-and-aft direction with the control mode switched from the swing control mode to the tilt control mode, thus allowing and facilitating a vertical pivoting of the support 31 of the dozer device 5 and a pivoting of the blade 30 to left-side up position or a right-side up position about the tilt pivot shaft 50 simultaneously by a single hand and a foot.

Also, to pivot the blade 30 vertically about the tilt pivot shafts 50 and pivot the blade 30 about the angle pivot shaft 49 to the right or left simultaneously, one simply holds the grip 87*a* of the dozer lever 87 and depresses the left-hand side or right-hand side of the angle control member 103 with, for example, the thumb of the holding hand to pivot the angle control member 103 to the right or left while stepping on the left-hand end or right-hand end of the swing pedal 83 to pivot the swing pedal 83 to a left-side down position or a right-side down position with the control mode switched from the swing control mode to the tilt control mode, thus allowing and facilitating a vertical pivoting of the blade 30 about the tilt pivot shafts (or shaft) 50 and a pivoting of the blade 30 to the left and right about the angle pivot shaft 49 simultaneously by a single hand and a foot.

Also, to pivot the pivot support 31 of the dozer device 5 vertically, pivot the blade 30 vertically about the tilt pivot shafts 50, and pivot the blade 30 about the angle pivot shaft 49 to the right or left simultaneously, one simply holds the grip 87*a* of the dozer lever 87 and depresses the left-hand side or right-hand side of the angle control member 103 with, for example, the thumb of the holding hand to pivot the angle control member 103 to the right or left while pivoting the dozer lever 86 in the fore-and aft direction and while stepping on the left-hand end or right-hand end of the swing pedal 83 to pivot the swing pedal 83 to a left-side down position or a right-side down position with the control mode switched from the swing control mode to the tilt control mode, thus allowing and facilitating vertical pivoting of the pivot support 31 of the dozer device 5, vertical pivoting of the blade 30 about the tilt pivot shafts (or shaft) 50 and a pivoting of the blade 30 to the left and right about the angle pivot shaft 49 simultaneously by a single hand and a foot.

Similar to the embodiment described above, when the left lock lever 89L or the right lock lever 89R is raised, this disables: operation of the implement 7, vertical pivoting of the pivot support 31 of the dozer device 5 by a pivoting of the dozer lever 87 in the fore-and-aft direction, pivoting of the blade 30 about the angle pivot shaft 49 by an actuation of the angle control member 103, swing operation of the implement 7 by stepping on the swing pedal 83, pivoting of the blade 30 about the tilt pivot shafts (or shaft) 50.

This can prevent unintentional movements of the dozer device 5 and the implement 7 caused by accidentally touching the dozer lever 87, the angle control member 103 of the dozer lever 87, or the swing pedal 83 when the operator gets on or off the swivel work machine 1.

Therefore, there are provided the angle control member 103 in the dozer control member 87, the angle control means for extending and retracting the angle cylinder 66 to pivot the blade 30 about the angle pivot shaft 49 in correlation with the angle control member 103, the tilt control means for controlling the tilt cylinder 71 to pivot the blade 30 about the tilt pivot shaft 50 in correlation with the swing control 83, a mode change-over means for switching between a tilt control mode in which the tilt cylinder 66 is controlled by the tilt control means in correlation with the operation of the swing control 83, and a swing control mode in which the swing cylinder 10 is controlled by the swing control means in correlation with the operation of the swing control 83, and the control valve 105A for the swing cylinder and the tilt cylinder corresponding to the swing cylinder 10 and the tilt cylinder 71, wherein the control valve 105A for the swing cylinder and the tilt cylinder is operated to swing the implement 7 to the right or left or to pivot the blade 30 about the tilt pivot shafts (or shaft) 50 in correlation with the operation of the swing control 83. And a directional control valve 107 is provided between (a) the swing cylinder 10 and the tilt cylinder 71 on the one hand, and (b) the control valve 105A for the swing cylinder and the tilt cylinder on the other wherein the directional control valve 107 is configured to be switched between a swing operation side in which the swing cylinder 10 is operated in correlation with the swing control 83 and a tilt operation side in which the tilt cylinder 71 is operated in correlation with the operation of the swing control 83. Therefore, with the control mode switched from the swing control mode to the tilt control mode, the blade 30 can be very conveniently and simultaneously pivoted vertically about the tilt pivot shafts (or shaft) 50 and to the right or left about the angle pivot shaft 49 with a single hand and a foot by actuating the swing pedal 83 while operating the angle control member 103 of the dozer lever 87.

In addition, in the above-described embodiment, since a switching between swing operations of the implement 7 by stepping on the swing pedal 83, and pivoting of the blade 30 vertically about the tilt pivot shafts (or shaft) 50 by stepping on the swing pedal 83 is done by the change-over switch 88, the swing operations of the implement 7 and vertical pivoting of the blade 30 about the tilt pivot shafts (or shaft) 50 cannot be performed simultaneously. However, since it is not necessary to perform a swing operation of the implement 7 and a pivoting of the blade 30 about the tilt pivot shafts (or shaft) 50 simultaneously in an ordinary work operation, this results in no inconvenience in a work operation.

In the embodiment of FIGS. 12 and 13 described above, there are provided the swing pedal 83, the dozer lever 87, the angle control member 103 provided in the dozer lever 87, wherein the implement 7 is swung to the right or left in correlation with the pedal operation of the swing pedal 83, and the pivot support 31 is pivoted vertically in correlation with an operation of the dozer lever 87, the blade 30 is pivoted about the angle pivot shaft 49 in correlation with the actuation of the angle control member 103, and there are also provided the swing control valve 105A for the swing cylinder and the tilt cylinder corresponding to the swing cylinder 10 and the tilt cylinder 71, wherein the control valve 105A for the swing cylinder and the tilt cylinder is operated to swing the implement 7 to the right or left or to pivot the blade 30 about the tilt pivot shafts (or shaft) 50 in correlation with the operation of the swing pedal 83. And a directional control valve 107 is provided between (a) the swing cylinder 10 and the tilt cylinder 71 on the one hand, and (b) the control valve 105A for the swing cylinder and the tilt cylinder on the other wherein the directional control valve 107 is configured to be switched between a swing operation side in which the swing cylinder 10 is operated in correlation with the swing pedal 83 and a tilt operation side in which the tilt cylinder 71 is operated in correlation with the operation of the swing pedal 83. Instead, an alternative configuration may be employed, in which the swing pedal 83 and the dozer lever 87 are provided without the angle control member 103 whereas the tilt control member may be provided to the dozer lever 87, and the implement 7 is pivoted to the left and right in correlation with the pedal operation of the swing pedal 83, and the pivot support 31 is pivoted vertically in correlation with an operation of the dozer lever 87, the blade 30 is pivoted about the tilt pivot shafts (or shaft) 50 in correlation with the operation of the tilt control member, and the control valve for the swing cylinder and the angle cylinder corresponding to the swing cylinder 10 and the angle cylinder 66 is provided in lieu of the control valve 105A for the swing cylinder and the tilt cylinder, wherein the control valve for the swing cylinder and the angle cylinder is operated to swing the implement 7 to the right or left or to pivot the blade 30 about the angle pivot shaft 49 in correlation with the operation of the swing pedal 83. And a directional control valve 107 is provided between (a) the swing cylinder 10 and the angle cylinder 66 on the one hand, and (b) the control valve for the swing cylinder and the angle cylinder on the other wherein the directional control valve 107 is configured to be switched between a swing operation side in which the swing cylinder 10 is operated in correlation with the swing pedal 83 and an angle operation side in which the angle cylinder 66 is operated in correlation with the operation of the swing control 83. In this case, with the control mode switched from the swing control mode to the angle control mode, the blade 30 can be very conveniently and simultaneously pivoted vertically about the tilt pivot shafts (or shaft) 50 and to the right or left about the angle pivot shaft 49 with a single hand and a foot by manipulating the tilt control member of the dozer lever 87 while stepping on the swing pedal 83.

In the embodiment described above, the tilt control member 92 and the angle control member 103 include a seesaw switch with a potentiometer, etc. Instead, the tilt control member 92 and the angle control member 103 may be a rotary switch or a dial switch.

Additionally, in the embodiment of FIGS. 1-12, when the left side or the right side of the tilt control member 92 of the dozer lever 87 is pressed down to pivot it to the right or left from the neutral position, a current or voltage of a magnitude proportional to the amount of the operation to the right or left is output to the controller 99 as an operation signal S1. The controller 99 then outputs the control signal S2 of a current or voltage proportional to the magnitude of the operation signal S1 inputted from the dozer lever 87 to the solenoid 66*b* or 66*c* of the electromagnetic valve 66B for pivoting the blade to the left, or the electromagnetic valve 66C for pivoting the blade to the right. This pivots the blade 30 to the right or left at a speed corresponding to the amount of the stepping operation of the tilt control member 92 to the right or left through the electromagnetic valve 66B for pivoting the blade to the left or the electromagnetic valve 66C for pivoting the blade to the right, and the angle cylinder control valve 66A. Instead, an alternative configuration may be employed in which, when the tilt control member 92 is pivoted to the right or left, an operation signal S1 (an ON-OFF signal) of a constant magnitude is output to the controller 99 from the tilt control member 92, which causes the angle cylinder 66 to be extended and retracted at a constant speed with the pivoting of the tilt control member 92 to pivot the blade 30 to the right or left at a constant speed. In this case, the system can be arranged such that when the tilt control member 92 is pivoted to the right or left, the controller 99 outputs a control signal S2 of a constant magnitude to the solenoid 43*b* or 43*c* of the electromagnetic valve 66B for pivoting the blade to the left or the electromagnetic valve 66C for pivoting the blade to the right, which in turn causes the blade 30 to pivot to the right or left at a constant speed through the electromagnetic valve 66B for pivoting the blade to the left or the electromagnetic valve 66C for pivoting the blade to the right, and the angle cylinder control valve 66A. Alternatively, the blade 30 may be pivoted to the right or left at a constant speed through use of a directional control valve for the angle cylinder control valve 66A, etc. in place of a proportional electromagnetic valve. Further, concerning the angle control member 103 of the dozer lever 87 in the embodiment in FIGS. 12 and 13, similar to the case of the tilt control element 92, when the angle control member 103 is pivoted to the right or left, the tilt cylinder 71 may be extended or retracted at a constant speed with the actuation of the angle control member 103 to pivot the blade 30 to a left-side up position or the right-side up position at a constant speed.

In addition, in the embodiment described above, when the dozer lever 87 is pivoted from the neutral position in the fore-and-aft direction, a current or voltage of a magnitude proportional to the amount of the forward or rearward lever operation is output to the controller 99 as an operation signal S1. The controller 99 then outputs the control signal S2 of a current or voltage proportional to the magnitude of the operation signal S1 inputted from the dozer lever 87 to the solenoid 43*b* or 43*c* of the electromagnetic valve 43B for raising the dozer, or the electromagnetic valve 43C for lowering the dozer. This causes the pivot support 91 to be pivoted vertically at a speed corresponding to the amount of forward and rearward operation of the dozer lever 87 through the electromagnetic valve 43B for raising the dozer, or the electromagnetic valve 43C for lowering the dozer, and the control valve 43A for the dozer cylinder. Instead, an alternative configuration may be employed in which, when the dozer lever 87 is pivoted forwardly or rearwardly from the neutral position, an operation signal S1 (an ON-OFF signal) of a constant magnitude is output to the controller 99, which causes the pivot support 31 to be pivoted vertically at a constant speed with the actuation of the dozer lever 87. In this case, the system can be arranged such that when the dozer lever 87 is pivoted forwardly or rearwardly from the neutral position, the controller 99 outputs a control signal S2 of a constant magnitude to the solenoid 43*b* or 43*c* of the electromagnetic valve 43B for raising the dozer or the electromagnetic valve 43C for lowering the dozer, which in turn causes the pivot support 31 to pivot vertically at a constant speed through the electromagnetic valve 43B for raising the dozer or the electromagnetic valve 43C for lowering the dozer, and the dozer cylinder control valve 43A. Alternatively, the pivot support 31 may be pivoted vertically at a constant speed through use of a directional control valve for the dozer cylinder control valve 43A, etc. in place of a proportional electromagnetic valve.

In addition, in the embodiment described above, by an upward operation of the right lock lever 89R, operations of the boom 15 and the bucket 17 by the boom and bucket control lever 86 are disabled, and operations of the arm 16 by the swing and arm control lever 90 are disabled.

And by an upward operation of the left lock lever 89L, operations of the swing cylinder 10 and the arm 16 by the swing and arm control lever 90 are disabled, and operations of the boom 15 and the bucket 17 by the boom and bucket control lever 86 are disabled. And by lowering both the left and right lock lever 89L, 89R, operations of the boom 15 and the bucket 17 by the boom and bucket control lever 86 are enabled, and operations of the arm 16 by the swing and arm control lever 90 are enabled. Instead, an alternative configuration may be employed in which, by raising the right lock lever 89R, operations of the boom 15 and the bucket 17 by the boom and bucket control lever 86 are disabled while by lowering the right lock lever 89R, operations of the boom 15 and the bucket 17 by the boom and bucket control lever 86 are enabled and in which, by rising the left lock lever 89L, operations of the arm 16 by the swing and arm control lever 90 is disabled while, by lowering the left lock lever 89L, operations of the arm 16 by the swing and arm control lever 90 is enabled.

In addition, in the embodiment of FIGS. 1-11, when the angle control mode is selected by a switching operation of the change-over switch 88, the angle cylinder 66 is controlled to pivot the blade 30 to the right or left about the angle pivot shaft 49 at a speed corresponding to the amount of the stepping operation of the swing pedal 83. Instead, an alternative configuration may be employed in which when the angle control mode is selected by a switching operation of the change-over switch 88, the angle cylinder 66 is controlled to pivot the blade 30 to the right or left about the angle fulcrum 49 at a constant speed in response to the stepping operation of the swing pedal 83. In addition, in the embodiment of FIGS. 12 and 13, when the tilt control mode is selected by a switching operation of the change-over switch 88, the tilt cylinder 71 is controlled to pivot the blade 30 vertically about the tilt pivot shafts or axis 50 at a speed corresponding to the amount of the stepping operation of the swing pedal 83. Instead, an alternative configuration may be employed in which when the tilt control mode is selected by a switching operation of the change-over switch 88, the tilt cylinder 71 is controlled to pivot the blade 30 vertically about the tilt pivot shafts or axis 50 at a constant speed in response to the stepping operation of the swing pedal 83.

Also, in the embodiment described above, although the lever lock mechanism 93 has two lock levers: the left lock lever 89L and the right lock lever 89R. However, the lever lock mechanism 93 may have only the one lock lever. Moreover, the lever lock mechanism 93 may have push buttons etc. in lieu of the lock levers 59L and 59R as long as it can switch between an ON state in which operation of the operational parts by the control levers 56 and 60 are enabled and an OFF state in which operation of the operational parts by the control levers 56 and 60 are disabled.

Moreover, although the present invention is applied to a backhoe in the embodiment described above, the applications of the present invention is not limited to the backhoe, but can be applied to any other work machines equipped with a dozer device. In addition, although the dozer control 87 is the dozer lever which is pivoted by hand and the swing control 83 is the swing pedal which is stepped on by a foot in the embodiment described above, the dozer control 87 may be a dozer pedal which may be stepped on by a foot, and the swing control 83 may be a swing lever which is pivoted by hand.

Also, in the embodiment described above, the dozer lever 87 and the swing pedal 83 are arranged to the right of the driver's seat 8 to be on the same side in the right and left or lateral direction. Instead, the dozer lever 87 and the swing pedal 83 may be arranged to the left of the driver's seat 8 to be on the same side in the right and left or lateral direction with respect to the driver's seat 8.

What is claimed is:

1. A swivel work machine comprising:

a travel device;

a swivel base provided on the travel device;

an implement provided to a front portion of the swivel base, the implement being capable of being pivoted to the right or left;

a dozer provided to the travel device, the dozer being supported so as to be capable of being pivoted vertically, of being pivoted about an angle pivot shaft extending vertically, and of being pivoted about a tilt pivot shaft extending in a fore-and-aft direction;

a swing control, an actuation of which causes the implement to be pivoted to the right or left;

a dozer control, an actuation of which causes the dozer to be pivoted vertically;

a tilt control member provided to the dozer control, an actuation of the tilt control member causing the dozer to be pivoted about the tilt pivot shaft;

a controller having a swing control mode in which an actuation of the swing control causes the implement to be pivoted vertically, and an angle control mode in which an actuation of the swing control causes the dozer to be pivoted about the angle pivot shaft; and a mode change-over portion for switching a control mode of the controller between the swing control mode and the angle control mode.

2. A swivel work machine in accordance with claim 1, wherein the dozer control includes a dozer lever configured to be pivoted by hand, and the swing control includes a swing pedal configured to be stepped on by a foot.

3. A swivel work machine in accordance with claim 1, wherein the dozer control and the swing control are located on a same side with respect to a driver's seat in a right/left direction.

4. A swivel work machine in accordance with claim 2, wherein the tilt control member is provided in a vicinity of a top end of the dozer lever.

5. A swivel work machine in accordance with claim 4, wherein the tilt control member is a seesaw switch, and the dozer is pivoted about the tilt pivot shaft in a direction corresponding to a pivoting direction of the seesaw switch.

6. A swivel work machine comprising:

a travel device;

a swivel base provided on the travel device;

an implement provided to a front portion of the swivel base, the implement being capable of being pivoted to the right or left;

a dozer provided to the travel device, the dozer being supported so as to be capable of being pivoted vertically, of being pivoted about an angle pivot shaft extending vertically, and of being pivoted about a tilt pivot shaft extending in a fore-and-aft direction;

a swing control, an actuation of which causes the implement to be pivoted to the right or left;

a dozer control, an actuation of which causes the dozer to be pivoted vertically;

an angle control member provided to the dozer control, an actuation of the angle control member causing the dozer to be pivoted about the angle pivot shaft;

a controller having a swing control mode in which an actuation of the swing control causes the implement to be pivoted vertically, and a tilt control mode in which an actuation of the swing control causes the dozer to be pivoted about the tilt pivot shaft; and a mode change-over portion for switching a control mode of the controller between the swing control mode and the tilt control mode.

7. A swivel work machine in accordance with claim 6, wherein the dozer control includes a dozer lever configured to be pivoted by hand, and the swing control includes a swing pedal configured to be stepped on by a foot.

8. A swivel work machine in accordance with claim 6, wherein the dozer control and the swing control are located on a same side with respect to a driver's seat in a right/left direction.

9. A swivel work machine in accordance with claim 7, wherein the angle control member is provided in a vicinity of a top end of the dozer lever.

10. A swivel work machine in accordance with claim 9, wherein the angle control member is a seesaw switch, and the dozer is pivoted about the angle pivot shaft in a direction corresponding to a pivoting direction of the seesaw switch.

* * * * *